US005940668A

United States Patent [19]

Tanigawa et al.

[11] Patent Number: 5,940,668

[45] **Date of Patent: *Aug. 17, 1999**

[54] IMAGE FORMING APPARATUS WITH VOLTAGE POLARITY SWITCHING MEANS

[75] Inventors: Koichi Tanigawa, Tokyo; Kimio Nakahata, Kawasaki; Akihiko Takeuchi, Yokohama; Hideo Nanataki; Kazuaki Ono, both of Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/841,674

[22] Filed: Apr. 30, 1997

Related U.S. Application Data

[60] Continuation of application No. 08/407,869, Mar. 21, 1995, abandoned, which is a division of application No. 08/215,666, Mar. 22, 1994, Pat. No. 5,438,398, which is a continuation of application No. 08/069,379, Jun. 1, 1993, abandoned.

[30] Foreign Application Priority Data

May 29, 1992 [JP] Japan ..... 4-164226

[51] Int. Cl.[6] ..... G03G 15/01; G03G 15/14

[52] U.S. Cl. ..... 399/302; 399/308

[58] Field of Search ..... 399/308, 302, 399/313, 314

[56] References Cited

U.S. PATENT DOCUMENTS

| | | | |
|---|---|---|---|
| 4,482,240 | 11/1984 | Kuge et al. . | |
| 4,588,279 | 5/1986 | Fukuchi et al. . | |
| 4,899,196 | 2/1990 | Mahoney | 355/271 |
| 4,931,839 | 6/1990 | Tompkins et al. | 355/277 |
| 5,084,735 | 1/1992 | Rimai et al. | 355/271 |
| 5,099,286 | 3/1992 | Nishise et al. | 355/272 |
| 5,153,654 | 10/1992 | Yuminamochi et al. | 355/277 |
| 5,159,390 | 10/1992 | Imaizumi | 355/212 |
| 5,177,549 | 1/1993 | Ohtsuka et al. | 355/284 |
| 5,179,397 | 1/1993 | Ohzeki et al. | 346/160 |
| 5,187,526 | 2/1993 | Zaretsky | 355/273 |
| 5,189,478 | 2/1993 | Hara et al. | 355/271 |
| 5,196,893 | 3/1993 | Nishise et al. | 355/271 |
| 5,223,900 | 6/1993 | Yuminamochi et al. | 355/273 |
| 5,243,392 | 9/1993 | Berkes et al. | 355/275 |
| 5,303,013 | 4/1994 | Koike et al. | 355/271 |
| 5,349,423 | 9/1994 | Nagato et al. | 355/285 |
| 5,410,392 | 4/1995 | Landa | 355/271 |

FOREIGN PATENT DOCUMENTS 1-105980 4/1989 Japan .

*Primary Examiner*—Richard Moses

*Attorney, Agent, or Firm*—Fitzpatrick, Cella, Harper, & Scinto

[57] ABSTRACT

An image forming apparatus includes a first image bearing member on which a toner image can be formed; an intermediate transfer member onto which the toner image is transferable from the first image bearing member; wherein the toner image is further transferred onto a second image bearing member therefrom; wherein the intermediate transfer member comprises a conductive layer to which a voltage is applied, a surface layer on the conductive layer, and a volume resistivity of the surface layer is $10^5$–$10^{11}$ ohm.cm.

8 Claims, 19 Drawing Sheets

IMAGE FORMING APPARATUS WITH VOLTAGE POLARITY SWITCHING MEANS

This application is a continuation of application Ser. No. 08/407,869, filed Mar. 21, 1995, now abandoned, which is a divisional of application Ser. No. 08/215,666, filed Mar. 22, 1994, now U.S. Pat. No. 5,438,398, issued Aug, 1. 1995, which is a continuation of application Ser. No. 08/069,379, filed Jun. 1, 1993, now abandoned.

FIELD OF THE INVENTION AND RELATED ART

The present invention relates to an image transfer type image forming apparatus such as a copying machine, printer or facsimile machine in which a transferable (visualized) image of image information is formed on a first image bearing member through an image forming process, and the transferable image is transferred onto a second image bearing member, and is outputted as a print, or wherein a transferable image formed on the first image bearing member is once transferred onto an intermediate transfer member, and is further transferred onto a second image bearing member, and is outputted as a print.

Here, the first image bearing member is either an electrophotographic photosensitive member, an electrostatic recording dielectric member, a magnetic recording magnetic member or the like. The image forming process is an electrophotographic process, an electrostatic recording process, magnetic recording process or the like.

The second image bearing member is either a transfer material, a recording sheet, a print sheet or another sheet material.

Referring first to FIG. 21, there is shown an example of an image forming apparatus using an intermediate transfer member. The image forming apparatus of this example is a color image forming apparatus (copying machine or laser beam printer) using an electrophotographic process.

Designated by a reference numeral 1 is an electrophotographic photosensitive member (photosensitive drum) as a repetitively usable image bearing member in the form of a rotatable drum, and is rotated in a direction indicated by an arrow (clockwise direction) at a predetermined peripheral speed (process speed).

During the rotation, the photosensitive drum 1 is uniformly charged to a predetermined potential and predetermined polarity by a primary charger (corona discharger) 2, and is then exposed to image light by an image exposure means (not shown), such as a color separation and imaging exposure optical system for a color original, or a scanning exposure system having a laser scanner for producing a laser beam modulated in accordance with a time series electric digital picture element signal corresponding to image information. By doing so, a first color separated image of the intended color image (magenta component image) is formed as an electrostatic latent image.

The electrostatic latent image is developed with a first color, that is, magenta toner M (coloring charged particles) by a first developing device 41 (magenta developing device). At this time, the second to fourth developing devices 42, 43 and 44 (cyan, yellow and black developing devices) are not operated so that they do not act on the photosensitive drum, and therefore, the first color magenta toner image is not influenced by the second to fourth developing devices 42–44.

Designated by a reference numeral 5 is an endless intermediate transfer belt (intermediate transfer member), which is stretched around a conductive roller 6, two turn rollers 71 and 72, namely, around three rollers 6, 71 and 72. The conductive roller 6 keeps the belt 5 in press-contact with the photosensitive drum 1 with a predetermined pressure. Between the photosensitive drum 1 and the intermediate transfer belt 5, a transfer nip N is formed (transfer position).

The intermediate transfer belt 5 is rotated in the indicated clockwise direction at the same peripheral speed as the photosensitive drum 1. To the conductive roller 6, a transfer bias of the polarity (positive) opposite from the polarity of the charged toner (negative) on the photosensitive drum 1, from a first bias voltage source 61. The intermediate transfer belt may be of a dielectric material film such as polyester, polyethylene or the like material film, or a multi-layer dielectric film lined with a conductive material at the backside thereof. While the first color (magenta) toner image on the photosensitive drum 1 surface passes through the transfer nip N, it is sequentially transferred onto a rotating intermediate transfer belt 5 by an electric field formed in the transfer nip by the transfer bias applied to the conductive roller 6.

The surface of the photosensitive drum 1, after the first color magenta toner image is transferred onto the intermediate transfer belt 5, is cleaned by a cleaning device 14.

Similarly, the following steps are carried out:

charging of the rotatable photosensitive drum; image exposure 3 of the second component image (cyan component image, for example); development with the cyan toner C of the second developing device 42 (cyan developing device); transfer of the cyan toner image (second color image) onto the intermediate transfer belt 5; and cleaning of the photosensitive drum 1 surface by the cleaning device 14:

charging of the rotatable photosensitive drum 1; image exposure of the third component image (yellow component image, for example); development with yellow toner Y of the third developing device 43 (yellow developing device); transfer of the third color (yellow) toner image onto the intermediate transfer belt; and cleaning of the photosensitive drum 1 surface by the cleaning device 14: and charging of the rotatable photosensitive drum 1; image exposure of the fourth color component image (black component image, for example); development with black toner B of the fourth developing device 44 (black developing device); transfer of the fourth color (black toner) image onto the intermediate transfer belt 5; and cleaning of the surface of the photosensitive drum 1 by the cleaning device 14.

The foregoing image forming-transfer cycle are sequentially carried out, so that the four toner images (magenta, cyan, yellow and black toner images) are sequentially and superposedly transferred onto the outer surface of the rotatable intermediate transfer belt 5, by which a combined color toner image (mirror image) is formed corresponding to the original color image.

Subsequently, a transfer material (sheet) 24 as the second image bearing member is fed one-by-one from a sheet cassette 9 by a sheet feeding roller 10, and is supplied to the transfer nip N at a predetermined timing by a pair of registration rollers along a transfer guide 12.

The bias voltage supplying voltage to the conductive roller 6 is switched from the first voltage source 61 to the second bias voltage source 62, so that the conductive roller 6 is supplied with a bias voltage of the polarity which is the same as that of the combined color toner image on the intermediate transfer belt 5, by which the combined color toner image is sequentially transferred from the intermediate transfer belt 5 onto the surface of the transfer material 24 supplied to the transfer nip N. The transfer material 24 having been subjected to the toner image transfer through the transfer nip N is introduced along a conveyance guide 13 into a fixing device 15 where it is heated and pressed by a temperature-controlled fixing roller 16 and the pressing roller 17, so that the image is fixed thereon. Then, it is discharged as a color print.

Designated by a reference numeral 8 is a cleaning device for the intermediate transfer belt, and is normally in an inoperative position relative to the belt. However, after the toner image transfer to the transfer material 24 is completed, it acts on the outer surface of the belt 5 to clean it.

(1) The apparatus using a dielectric material belt 6 as an intermediate transfer member as in FIG. 21, involves the following problems.

Disturbance of the image upon transfer:

In order to properly transfer the toner image from the photosensitive drum 1 onto the intermediate transfer belt 5 of the electrically insulative, it is required to increase the transfer bias voltage applied to the conductive roller 6, and therefore, a strong electric field is produced in the transfer nip N and the space before and after the nip.

Therefore, the toner image on the photosensitive drum 1 is attracted onto the intermediate transfer belt 5 before the transfer nip N (upstream of the transfer nip N with respect to the transfer material conveying direction), with the result that the toner scatters around the image.

In addition, static electricity is produced due to the triboelectricity between the insulative intermediate transfer belt 5 and the photosensitive drum, 1 or between the insulative intermediate transfer belt 5 and the transfer material 24, with the result that the separation discharge mark appears on the intermediate transfer belt 5, thus disturbing the image.

Furthermore if the voltage applied to the conductive roller 6 from the first or second bias source 61 or 62 to provide a strong electric field, the electric current leaks through a small defect such as a pin hole which may exist in the intermediate transfer belt 5, with the result of damage to the intermediate transfer belt 5 or the photosensitive drum 1.

If such current leakage occurs, the toner image transfer is no longer possible to the intermediate transfer belt 5 with the result being a local defect on the toner image transferred onto the intermediate transfer belt 5.

(2) When the toner image is transferred from the photosensitive drum 1 to the intermediate transfer belt 5, the central drop-out of transfer easily occurs in the toner image T on the belt 5, as indicated by a in FIG. 23. This is because the surface of the photosensitive drum 1 has an attraction force to the toner, and this occurs more if the toner attraction force to the belt 5 is smaller.

The same applies to the toner image transfer from the intermediate transfer belt 5 to the transfer material 24 after the sequential superposing transfer process for the first to fourth colors. Conversely, however, the central droplet occurs less if the toner deposition force to the belt 5 is smaller. Therefore, in the image forming apparatus using such an intermediate transfer member 5, there has not been a proper intermediate transfer member providing proper toner deposition force, and therefore it has been difficult to form an image on the transfer material 24 without the central drop-out.

(3) In a color image forming apparatus using an intermediate transfer material, when a monochromatic image is produced, the toner image is temporarily transferred from the photosensitive drum to the intermediate transfer member, and thereafter, it is transferred further onto the transfer material, and therefore, the image forming speed is much lower than when the toner image is directly transferred from the photosensitive drum onto the transfer material.

(4) In an image forming apparatus using an intermediate transfer material, the resistance of the intermediate transfer material changes due to the variation of the ambient condition such as the temperature or humidity, and therefore, the transfer property changes due to the ambient condition change.

SUMMARY OF THE INVENTION

Accordingly, it is a principal object of the present invention to provide an image forming apparatus which is capable of forming images without toner scattering and image disturbance attributable to the separation discharge.

It is another object of the present invention to provide an image forming apparatus capable of forming images without central drop-out.

It is a further object of the present invention to provide an image forming apparatus having a high image forming speed.

It is yet a further object of the present invention to provide an image forming apparatus capable of forming proper images irrespective of ambient condition.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
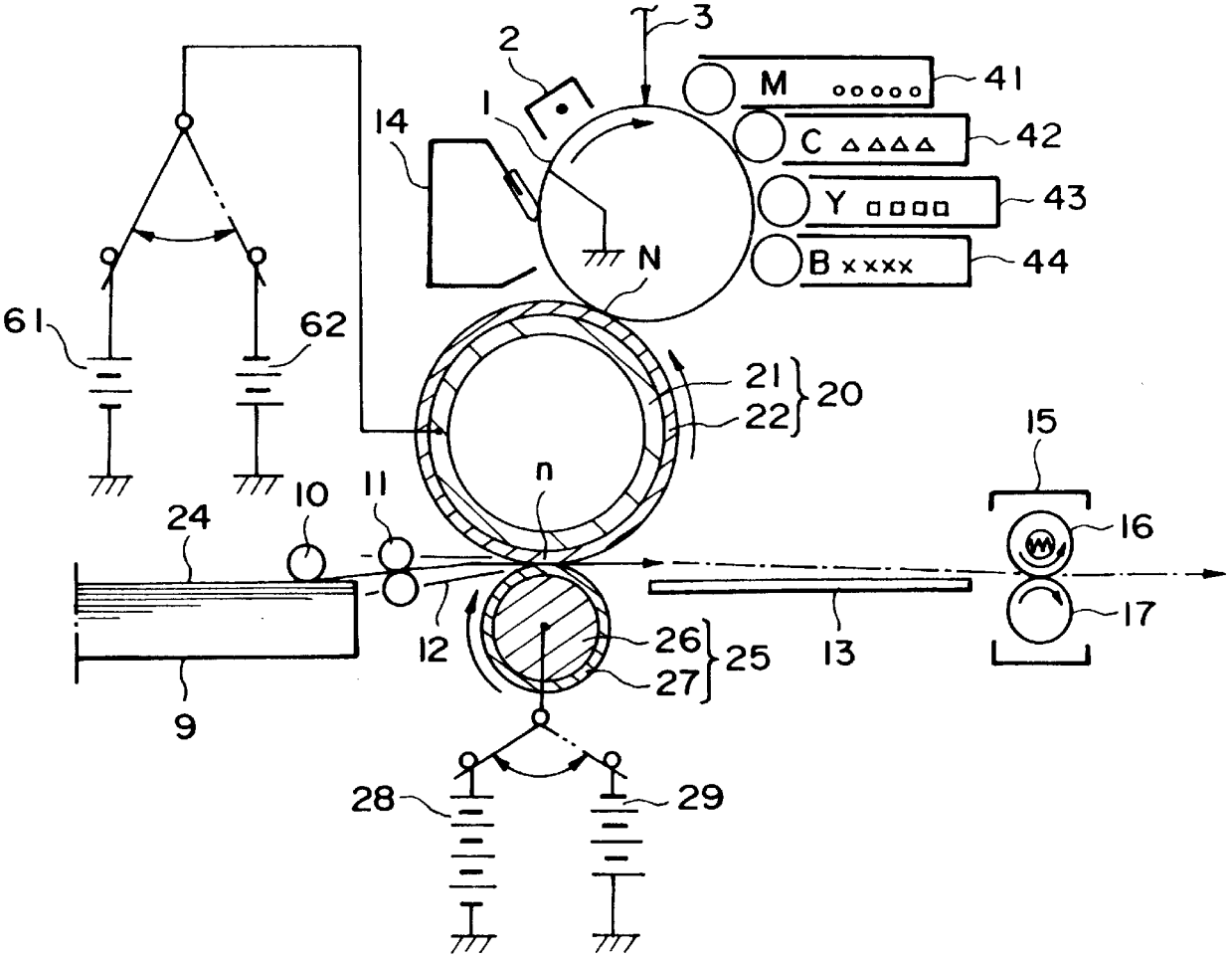
FIG. 1 is a sectional view of an image forming apparatus according to a first embodiment of the present invention.
Figure 21:
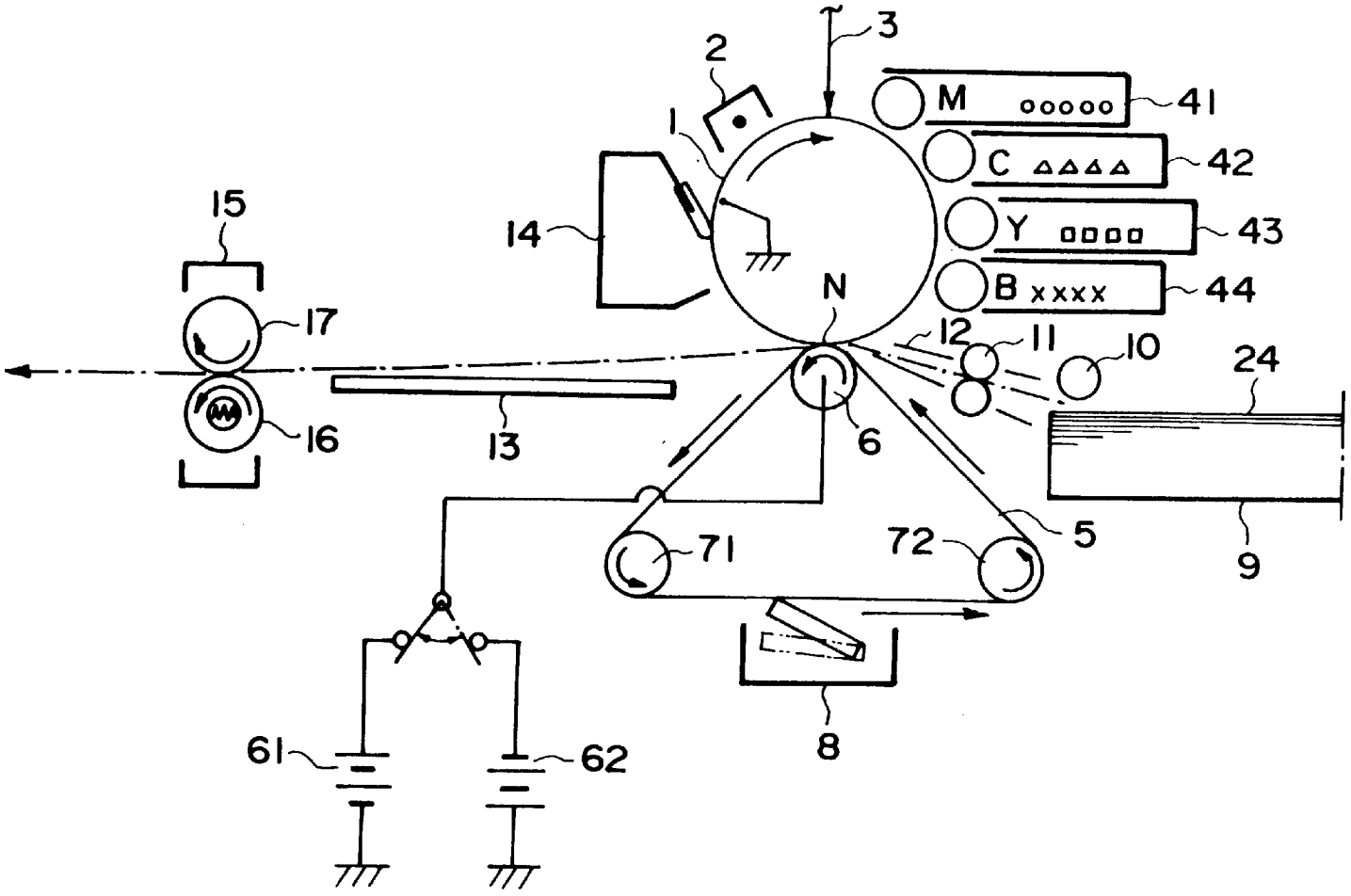
FIG. 21 is a sectional view of a conventional example of image forming apparatus.

Referring now to FIG. 1, there is shown an example of an image forming apparatus using an intermediate resistance elastic roller (intermediate transfer roller) 20, in an image forming apparatus shown in FIG. 21. The image forming apparatus of this example is in the form of a color image forming apparatus (copying machine or a laser beam printer) using an electrophotographic process.

(1) Designated by a reference numeral 1 is a rotatable drum type electrophotographic photosensitive member (photosensitive drum) which is repetitively usable as a first image bearing member, and it comprises a photosensitive layer, an electrically conductive base member which functions to support the photosensitive layer which is electrically grounded. It is rotated in the indicated clockwise direction at a predetermined peripheral speed (process speed).

During rotation of the photosensitive drum 1, it is uniformly charged to a predetermined polarity and potential by a binary charger (corona discharger) 2, and is exposed to image light 3 by unshown image exposure means (a color separation and imaging exposure optical system for color originals or a scanning exposure system including a laser scanner for emitting a laser beam modulated in accordance with time series electric digital pixel signals representative of image information to be printed) for a first color component (magenta component) of the color image to be printed. Thus, an electrostatic latent image for the color is produced.

Subsequently, the electrostatic latent image is developed with magenta toner M (coloring charged particles) (first color) by a first developing device 41 (magenta developing device). At this time, the second to fourth developing devices 42, 43 and 44 (cyan, yellow and black developing devices) are in an inoperative state, and therefore, they do not act on the photosensitive drum 1, so that the first color magenta toner image is not disturbed by the developing devices 42, 43 and 44.

In this embodiment, the intermediate transfer roller 20 comprises an electrically conductive core metal 21 in the form of a pipe and an elastic layer 22 having an intermediate resistance formed around the core metal 21.

The intermediate resistance elastic layer 22 comprises elastic material such as silicone rubber, tetrafluoroethylene rubber, chloroprene rubber, urethane rubber, EPDM (terpolymer of ethylene propylene dien), and metal oxide such as carbon or zinc oxide or the like dispersed therein so that the electric resistance (volume resistivity) is intermediate ($10^5$–$10^{11}$ ohm.cm). It is solid or foamed material.

In the apparatus of this embodiment, a transfer material (sheet) 24 having an A4 size is longitudinally fed, and the intermediate transfer roller 20 has a peripheral length which is slightly larger than the length of the A4 size transfer material 24 (314 mm, roller outside diameter is 100 mm). The elastic layer 22 has a thickness of 8 mm and a hardness of 20–40 degrees (Asker C hardness).

The intermediate transfer roller 20 is supported in parallel with the photosensitive drum 1, and is contacted to a bottom surface of the photosensitive drum 1. It is rotated at the same peripheral speed as the photosensitive drum 1 in the indicated counterclockwise direction. While the first color magenta toner image formed on the photosensitive drum 1 passes through a transfer nip N where the drum 1 and the intermediate roller 20 are contacted to each other, the image is continuously transferred to an outer surface of the roller 20 by an electric field formed in the transfer nip N by the transfer bias applied to the roller 20.

The surface of the photosensitive drum 1 from which the first color magenta toner image has been transferred to the intermediate transfer roller 20 is cleaned by a cleaning device 14.

Similarly, the above process is repeated as follows:

(2) Charging of the rotating photosensitive drum 1; image exposure 3 corresponding to a second component image (cyan component image, for example); development with cyan toner C by a second developing device 42 (cyan developing device); transfer of a second color cyan toner image onto an intermediate transfer roller 20; and cleaning of the photosensitive drum 1 surface by a cleaning device 14;

(3) Charging of a rotatable photosensitive drum 1; image exposure of a third color component image (yellow component image, for example); development with yellow toner Y by a third developing device 43 (yellow developing device); transfer of a third yellow toner image onto the intermediate transfer roller 20; and cleaning of the photosensitive drum 1 surface by the cleaning device 14; and (4) Charging of the rotatable photosensitive drum 1; image exposure 3 of a fourth color component image (black, for example); development with black toner B by a fourth developing device 44 (black developing device); transfer of a fourth color black toner image onto the intermediate transfer roller 20; and cleaning of the photosensitive drum 1 surface by the cleaning device 14.

By the sequential execution of the imaging and transfer cycles (1)–(4), the four toner images (magenta, cyan, yellow and black toner images) are sequentially and superposedly transferred onto the intermediate transfer roller 20, and therefore, a combined color toner image (mirror image) corresponding to the intended color image is formed.

Designated by a reference numeral 25 is a transfer roller supported in parallel with the intermediate transfer roller 20 so as to be contacted to the bottom surface of the intermediate transfer roller 20, and it is rotated at the same peripheral speed as the intermediate transfer roller 20 in the indicated clockwise direction.

The transfer roller 25 comprises a core roller 26 and a thin parting layer 27 formed on the outer peripheral surface thereof. The parting layer 27 is of fluorine resin such as PFA or PTFE or the like. It has a thickness of 20–100 microns.

The sequential toner image formation process for the first to fourth colors to the photosensitive drum 1, are the same as in the case of FIG. 21. The toner is a non-magnetic one component toner having a volume average particle size of 5–8 microns, and the specific charge thereof is −8–−18 μc/gr, and it is chargeable to the negative polarity.

The sequential and superposing transfer of the toner images for the first to fourth colors from the photosensitive drum 1 onto the outer surface of the intermediate transfer roller 20 is carried out while the core metal 21 of the intermediate transfer roller 20 is supplied with a transfer bias voltage of the polarity opposite (+) from that of the toner from a bias voltage source 61. The applied voltage was in this embodiment +2 KV–+5 KV.

In the sequential transfer process for the first to fourth color toner images from the photosensitive drum 1 to the intermediate transfer roller 20, the core metal 26 of the transfer roller 25 is supplied with a bias voltage of the same polarity (−) as the toner from a second bias voltage source 29. The bias voltage produces a repelling electric field for repelling the toner from the transfer roller 25 to the intermediate transfer roller 20, so that the transfer of the toner image from the intermediate transfer roller 20 to the transfer roller 25 is prevented.

When the toner image is transferred from the photosensitive drum 1 onto the intermediate transfer roller 20, the potential of the non-image portion is different from that of the toner image portion. With the potential of the core metal 21 being reference potential, the potential difference from the non-image portion is larger than the potential difference from the toner image portion, and therefore, the transfer current flows more into the non-image portion.

This tendency is remarkable when the resistance of the intermediate transfer roller 20 is low. For example, when the current into the non-image portion is not less than twice the current into the toner image portion, the electric field in the non-image portion influences the toner image with the result of the toner scattered around the toner image. In other words, a low resistance roller 20 is not suitable for an intermediate transfer member.

On the contrary, in the case of a high resistance roller, the electric field capable of being formed by the bias voltage source 61 is too small with the result of the function of the intermediate transfer roller deteriorated. As a result of experiments and investigations by the inventors, in order to prevent the scattering and improper transfer onto the intermediate transfer member, a volume resistivity of a surface layer on the core metal of the intermediate transfer member is preferably $10^5$–$10^{11}$ ohm.cm, preferably $10^7$–$10^{10}$ ohm.cm (intermediate resistance layer). If the elastic layer 22 has the volume resistivity of this range, the proper transfer current can be provided by the application of +2–+5 KV to the core metal 21.

The first to fourth color toner images superposedly transferred onto the intermediate transfer roller 20 from the photosensitive drum 1, is transferred onto a transfer material 24 fed at predetermined timing into a nip n between the intermediate transfer roller 20 and the transfer roller 25. The transfer material is fed out one-by-one from a sheet feeding cassette 9 by a sheet feeding roller 10, and is supplied to the transfer nip n by a pair of registration rollers and along a transfer guide 22. When the transfer material reaches the nip n, the bias voltage source is switched from the second bias voltage source 29 to the first bias voltage 28, and the core metal 26 is supplied with a transfer bias voltage of the polarity (+) polarity from that of the toner. An absolute value of the transfer bias voltage is larger than the bias voltage of the polarity (+) opposite from that of the toner, applied from the bias voltage source 61 to the core metal 21 of the intermediate transfer roller. By the transfer bias voltage, the toner image is transferred from the intermediate transfer roller 20 onto the transfer material 24 supplied into the nip n between the intermediate roller 20 and the transfer roller 25. The transfer material 24 now having the toner image transferred thereto is introduced into an image fixing device 15 wherein it is heated and pressed by a temperature-controlled fixing roller 16 and a pressing roller 17 into a fixed color image. Then, it is discharged as a color print.

When the transfer material 24 passes through the nip n, the bias voltage sources for the core metal 21 and the core metal 26 are switched to the second bias voltage sources 62 and 29 of the same polarity (−) as the toner.

By the switching of the bias, the toner remaining on the surface of the intermediate transfer roller 20 is returned onto the photosensitive drum 1 surface, and it is collected by the cleaning device 14, by which the intermediate transfer roller 20 surface is cleaned.

The toner deposited on the transfer roller 25 surface is returned to the intermediate roller 20, and is further returned onto the photosensitive drum 1 surface, and therefore, it is also collected by the cleaning device 14. Thus, the transfer roller 25 is also cleaned.

As described, the intermediate transfer roller 20 has an intermediate resistance elastic layer 22, and therefore, the remaining toner is sufficiently returned to the photosensitive drum 1 surface by the bias voltage application (cleaning bias) of the same polarity as that of the toner. Thus, the toner is effectively transferred back to clean it without use of a particular cleaning device, thus simplifying the structure of the apparatus.

The intermediate transfer roller 20 is driven by a gear (not shown) integral with the core metal 21. As contrasted to the case of the intermediate transfer belt, there is no need for using a complicated mechanism such as a lateral shift preventing mechanism, thus simplifying the structure of the apparatus.

EMBODIMENT 2

(FIGS. 2–4)

Figure 2:
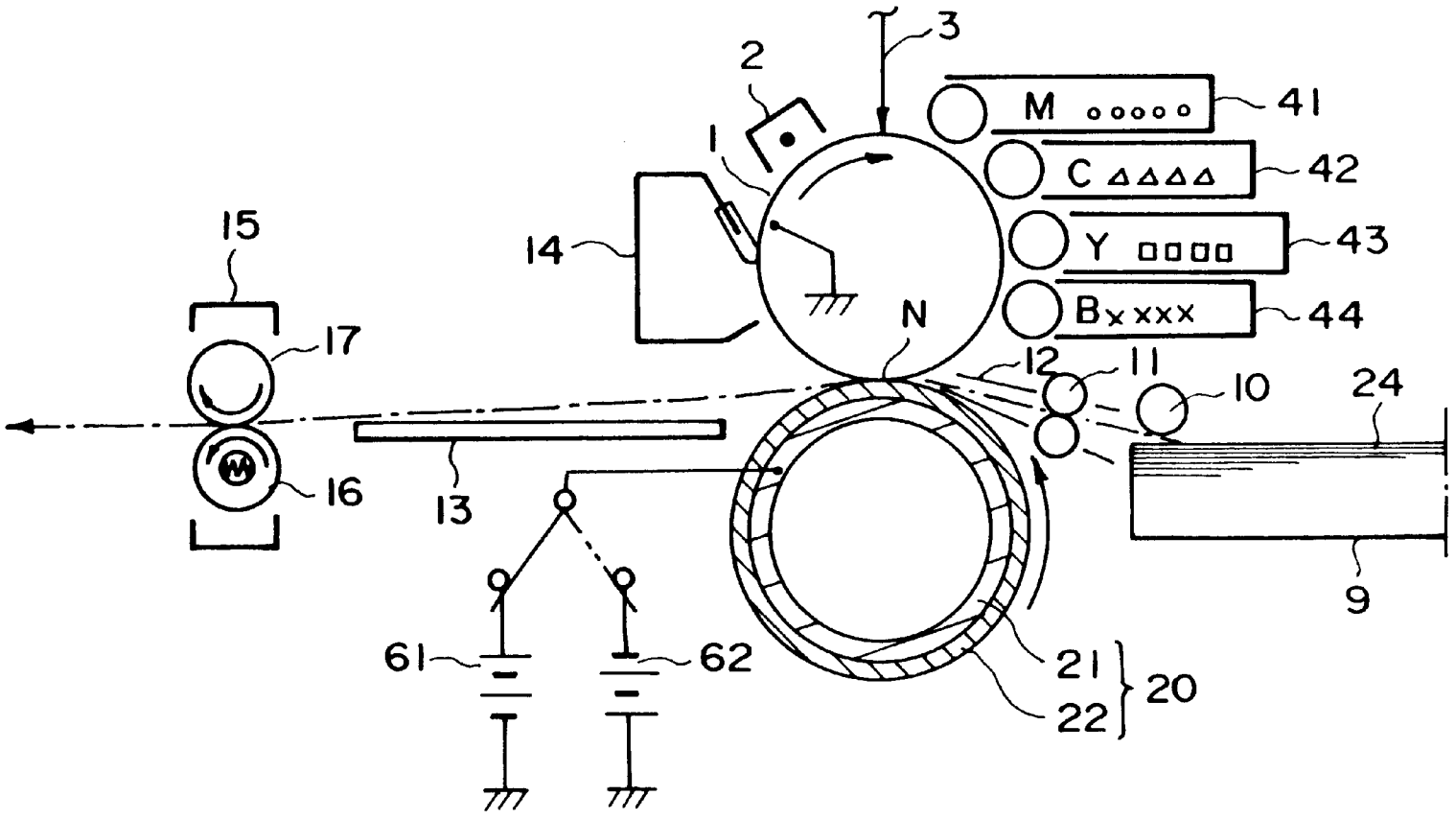
FIG. 2 is a sectional view of an image forming apparatus according to a second embodiment of the present invention.

In the apparatus of the first embodiment (FIG. 1), the image transfer from the intermediate transfer roller 20 onto the transfer material 24 is carried out while the transfer material 24 is passed through the nip n between the intermediate transfer roller 20 and a transfer roller 25 press-contacted thereto. In this embodiment, as shown in FIG. 2, the transfer material 24 is fed into the transfer nip N between the photosensitive drum 1 and the intermediate transfer roller 20, and there is no need to use the transfer roller 25.

The sequential and superposing transfer of the toner image of the first to fourth color toner images from the photosensitive drum 1 onto the intermediate transfer roller 20 is carried out while a transfer bias of the opposite (+) polarity from that of the toner from the first bias voltage source 21 to the core metal 21 of the intermediate transfer roller 20.

Figure 3:
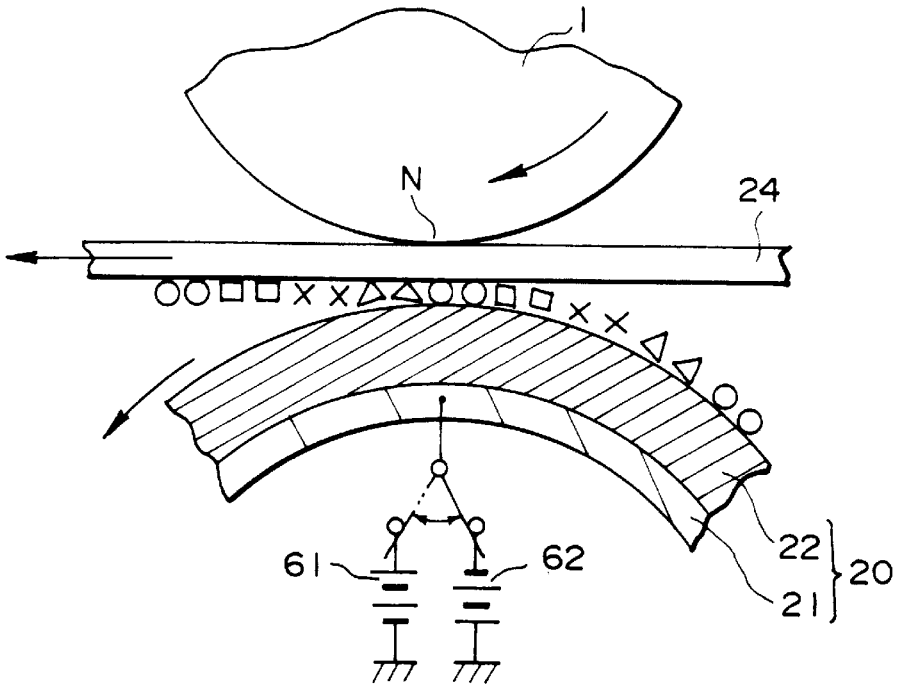
FIG. 3 schematically illustrates an image transfer process from an intermediate transfer roller onto a transfer material for formation of combined color toner images.

The transfer of the toner image from the intermediate transfer roller 20 to the transfer material 24 is carried out while the core metal 21 is supplied with a bias voltage of the same (−) polarity as that of the toner after the bias voltage source is switched from the first bias source 61 to the second bias source 62 as shown in FIG. 3.

Figure 4:
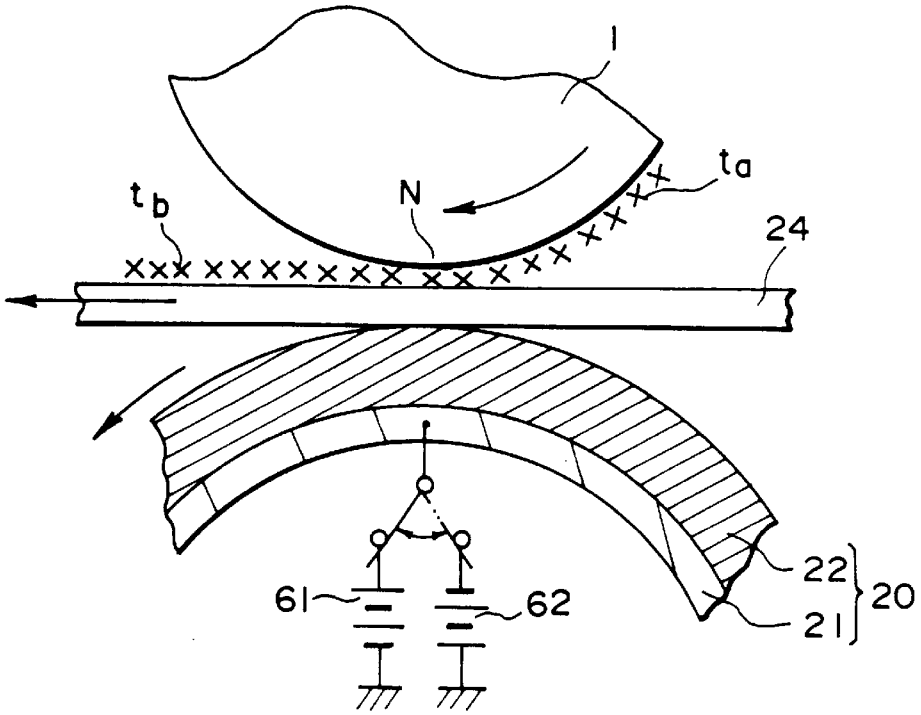
FIG. 4 schematically illustrates an image transfer process in the case of a monochromatic print.

In the case of a monochromatic print, as shown in FIG. 4, the transfer material 24 is supplied at the predetermined timing into a transfer nip N between the photosensitive drum 1 and the intermediate transfer roller 20 without transfer of the toner image (monochromatic toner image $t_a$ from the photosensitive drum 1 onto the intermediate transfer roller 20. By the application of a transfer bias of the same polarity as that of the toner from the first bias voltage source 61 to the core metal 21 of the intermediate transfer roller 20, the toner image $t_a$ may be directly transferred onto the surface of the transfer sheet 24 ($t_b$), by which the printing process is simplified.

Also when there is a transfer material 24 between the photosensitive drum 1 and the intermediate transfer roller 20, there is an imbalance in the transfer currents for the toner image portion and the non-image portion, as has been described in connection with the first embodiment, and by the fact that the elastic layer 22 of the intermediate transfer roller 20 has an intermediate resistance, a proper and satisfactory transfer is accomplished.

In either case of FIGS. 3 and 4, the removal of the toner from the intermediate transfer roller 20 after the toner image transfer completion to the transfer material 24 is carried out by application of a bias voltage of the same polarity (−) as the toner from the second bias voltage source 62 to the core metal 21 of the roller 20. By the bias voltage application, the toner remaining on the roller 20 transfers back to the photosensitive drum 1, and is collected by the cleaning device 14 for the photosensitive drum 1, thus effecting the cleaning of the roller 20.

EMBODIMENT 3

(FIG. 5)

Figure 5:
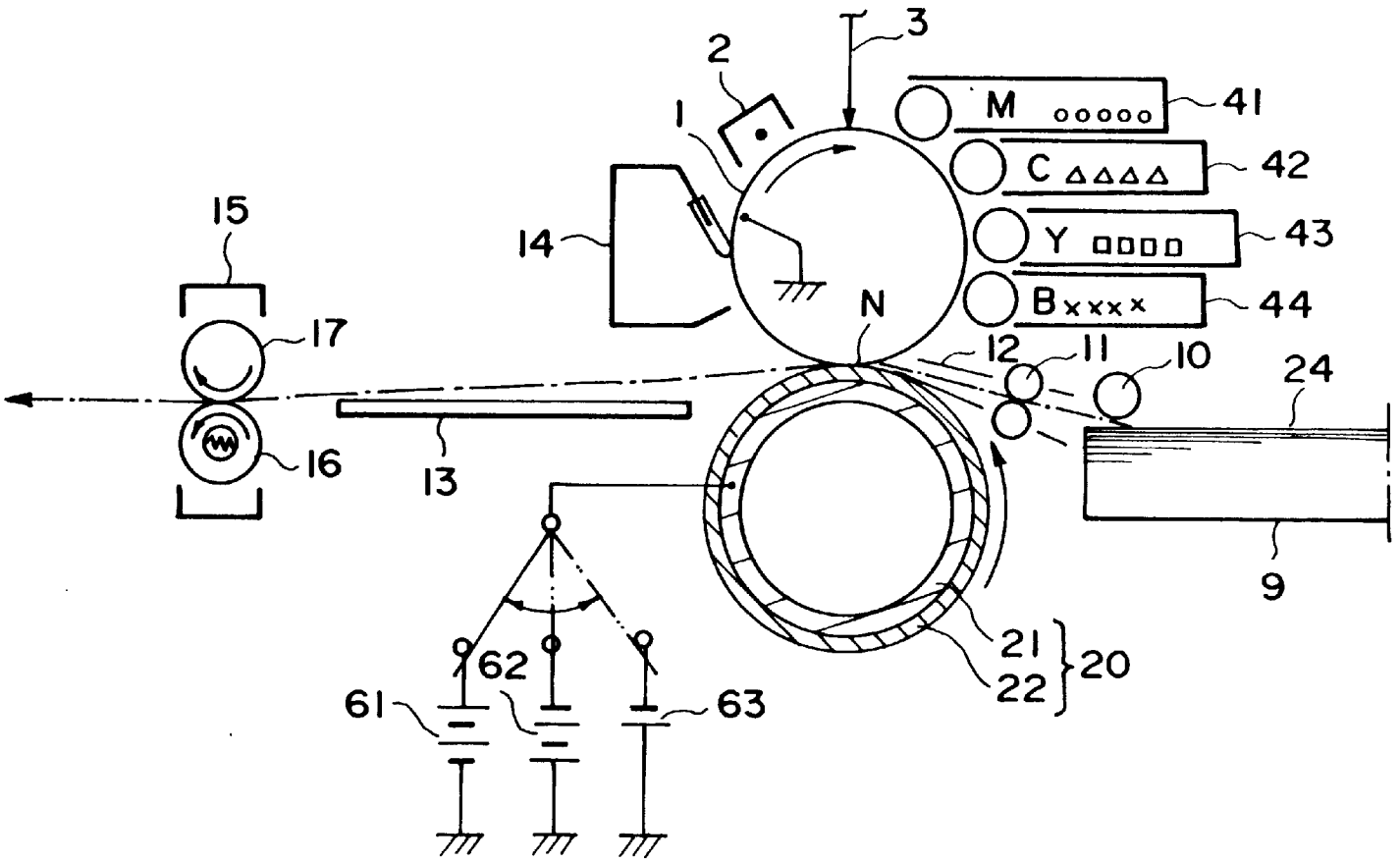
FIG. 5 is a sectional view of an image forming apparatus according to a third embodiment of the present invention.

FIG. 5 is a sectional view of an image forming apparatus according to a third embodiment of the present invention. In this embodiment, the intermediate roller 20 is capable of being supplied with a voltage from three voltage sources, namely, first, second and third bias voltage sources. The other structures are the same as in the second embodiment apparatus (FIG. 2). Similarly to the second embodiment, the first and second bias voltage sources 61 and 62 are voltage sources for applying a transfer bias voltage of the polarity (+) opposite from that of the toner to the core metal 21 of the intermediate transfer roller 20 during the toner image transfer operation from the photosensitive drum 1 to the intermediate transfer drum 20, and a voltage source for applying a transfer bias voltage of the same polarity (−) as that of the toner to the core metal 21 of the intermediate transfer roller 20 during the toner image transfer operation from the intermediate transfer roller 20 to the transfer material 24.

The third bias voltage source 63 functions as a cleaning bias application voltage source. After the completion of the toner image transfer from the intermediate transfer roller 20 to the transfer material 24, the bias voltage source for the core metal 21 of the intermediate transfer roller 20 is switched from the second voltage source 62 to the third bias voltage source 63, so that the intermediate transfer roller 20 is supplied with a cleaning bias voltage of the same polarity (−) as the toner to the intermediate transfer roller 20, by which the toner remaining on the outer peripheral surface of the intermediate transfer roller 20 is removed therefrom to be transferred back to the photosensitive drum 1 surface at the transfer nip N. The toner returned to the photosensitive drum 1 is collected by the cleaning device 14, and therefore, the surface of the photosensitive drum 1 is also cleaned. The third bias voltage source 63 may have a lower output voltage than the second bias voltage source 62, and when there is no transfer material in the nip N, the excessive charge application from the roller 20 to the drum 1 can be prevented.

EMBODIMENT 4

Figure 6:
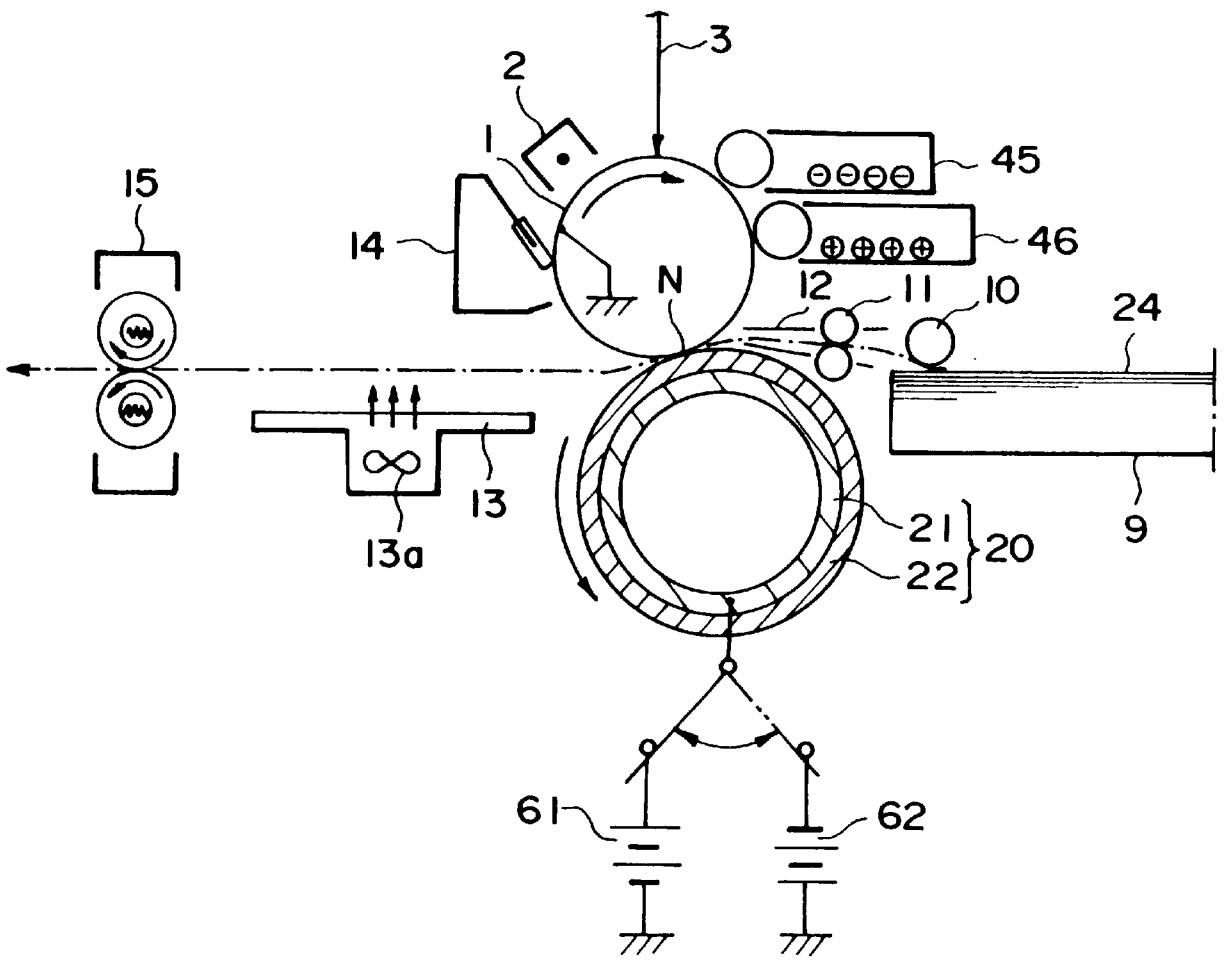
FIG. 6 is a sectional view of an image forming apparatus according to a fourth embodiment of the present invention.
Figure 7:
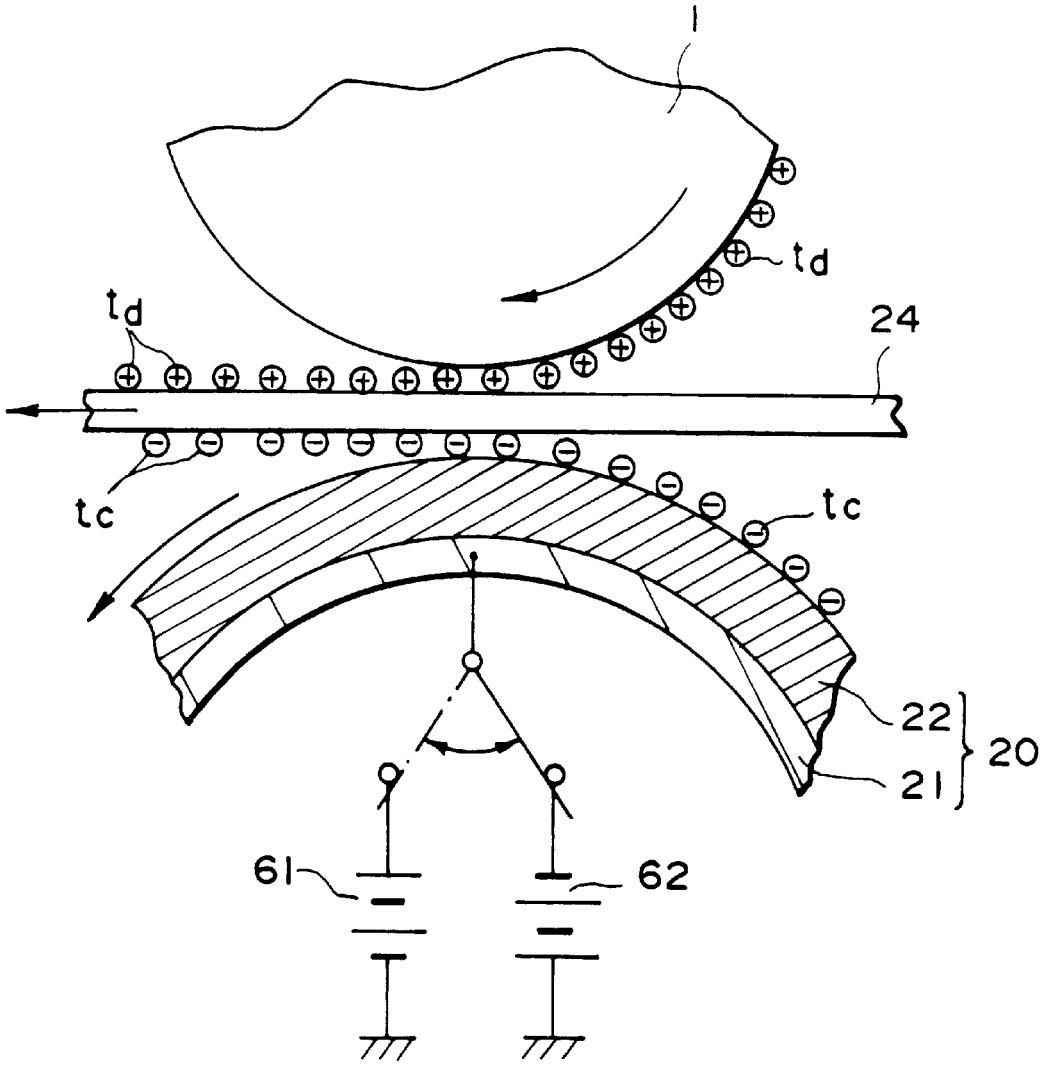
FIG. 7 schematically shows an image transfer process in the case of duplicate print.

(FIGS. 6 and 7)

The apparatus of this embodiment is capable of printing on both sides of the transfer material 24. In FIG. 6, designated by reference numerals 45 and 46 are a negative developing device containing negative polarity toner and a positive developing device containing positive toner.

A latent image for the image information for a first side is first formed on the surface of the photosensitive drum 1, and the latent image is developed by the negative developing device 45 (the positive developing device 46 is in an inoperative state). The negative polarity toner image is transferred temporarily onto the outer peripheral surface of the intermediate transfer roller 20. During the intermediate transfer operation, the core metal 21 of the roller 20 is supplied with a positive polarity bias voltage from the first bias voltage source 61.

Subsequently, a latent image of image information for the second side is formed on the surface of the photosensitive drum 1, the latent image is developed by the positive developing device 46, and the negative developing device 45 is in an inoperative state.

In synchronism with the formation of the toner image, the transfer material 24 is fed to the transfer nip N formed between the photosensitive drum 1 and the intermediate transfer roller 20 from the sheet feeding cassette 9.

Immediately before the transfer material 24 enters the transfer nip N, the bias voltage source for the core metal 21 of the intermediate transfer roller 20 is switched from the first bias voltage source 61 to the second bias voltage source 62, so that the core metal 21 is supplied with a negative polarity bias voltage. As shown in FIG. 7, by doing so, the negative polarity toner image $t_c$ carried on the intermediate transfer roller 20 surface is transferred onto the first side (bottom side) of the supplied transfer material 24, and simultaneously, the positive polarity toner image $t_d$ is transferred from the photosensitive drum 1 onto the second side (top side) of the supplied transfer material 24.

The transfer material 24 discharged from the transfer nip N has the toner images on both sides of the transfer material. To prevent rubbing contact between the toner image and other parts until it is introduced into the fixing device 15, the conveyance guide 18 provides upward air flow by a fan 13*a*. The toner images on the opposite sides of the transfer material 24 are fixed by the fixing device 15.

By utilizing a roller 20 as the intermediate transfer material, both side copy (duplex) print can be accomplished with a simplified sheet conveying arrangement.

In the case of a simplified mode (one side print), either the negative developing device 45 or positive developing device 46 is used to form a toner image on the photosensitive drum 1, and on the other hand, the transfer material 24 is supplied to the transfer nip N, while the core metal 21 of the intermediate transfer roller 20 is supplied with a bias voltage of the polarity opposite from that of the toner from the first or second bias voltage source 61 or 62.

In the case of the transfer of different polarity, the intermediate resistance roller 20 (intermediate transfer member) provides a stabilized image transfer function, and therefore, satisfactory images can be provided. In the foregoing explanation, an intermediate transfer roller 20 having a single elastic layer 22. However, multi-layer structure is usable for the elastic layer 22, or the elastic layer 22 may be coated with smooth surface layer.

As has been described in connection with embodiments 1, 2, 3 and 4, by using the intermediate elastic material roller 20 as the intermediate transfer member or roller, the disturbance of the transferred image can be prevented, and in addition, an image forming apparatus using an intermediate transfer member can be accomplished with simple structure.

In the following embodiments 5, 6, 7 and 8, the central dropout of the toner image can be prevented.

EMBODIMENT 5

Figure 8:
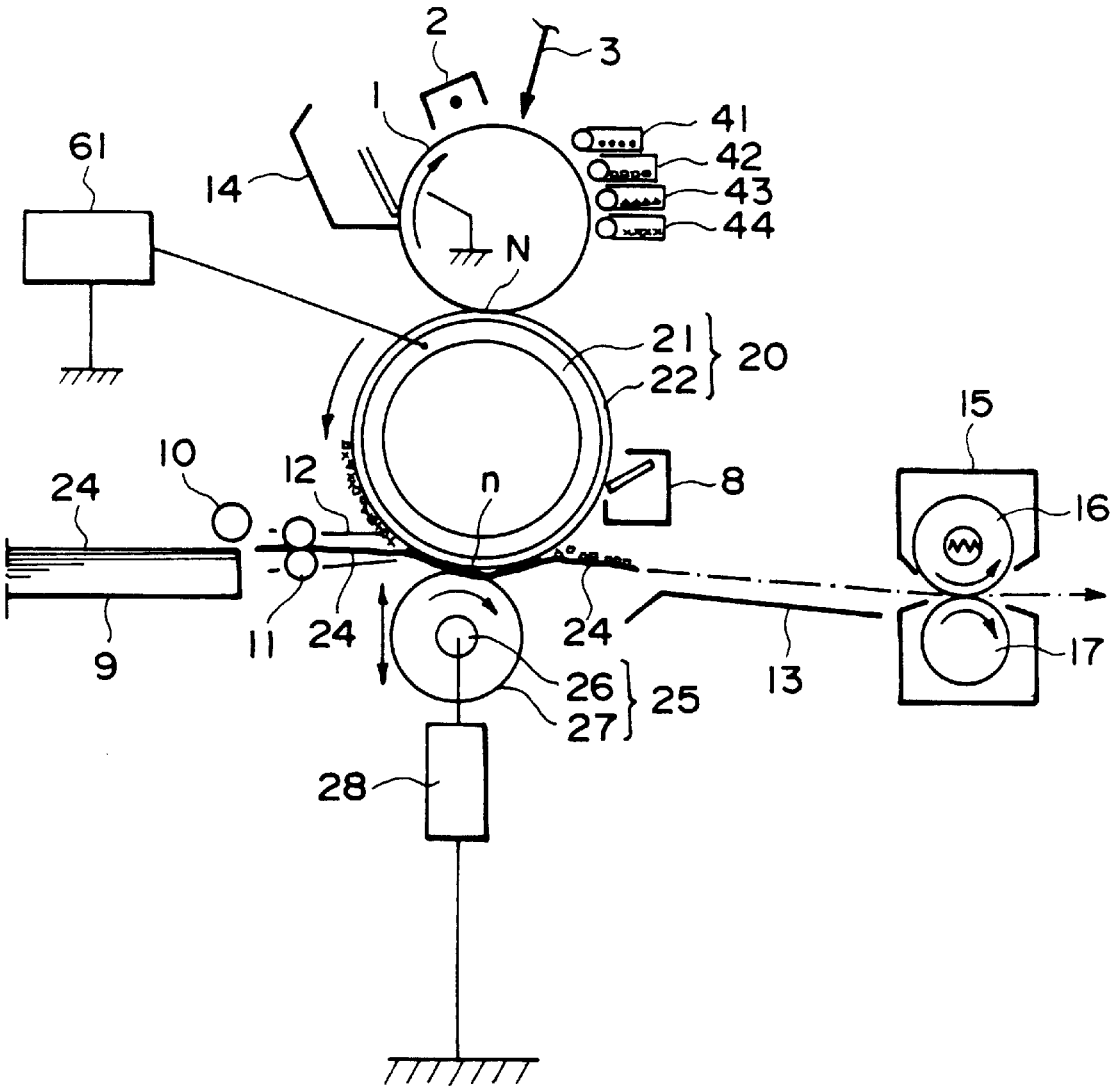
FIG. 8 is a sectional view of an image forming apparatus according to a fifth embodiment of the present invention.
Figure 9:
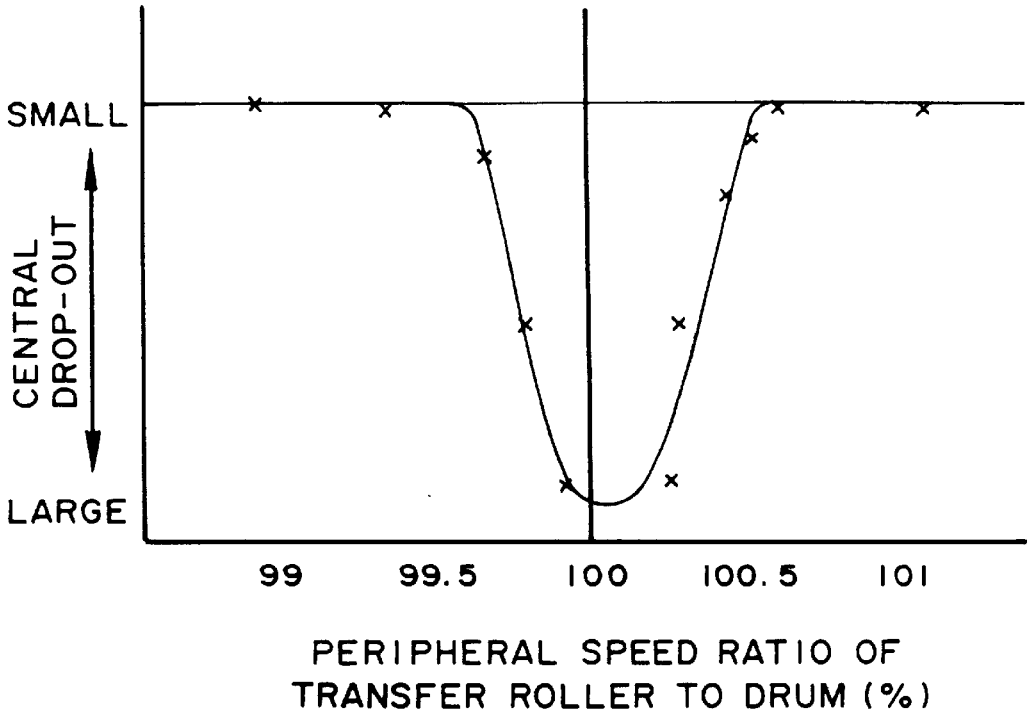
FIG. 9 shows a relation between a peripheral speed of an intermediate transfer roller and a degree of an image transfer drop-out.

(FIGS. 8 and 9)

FIG. 8 shows an image forming apparatus according to this embodiment, which is similar to the apparatus of the first embodiment (FIG. 1).

The intermediate transfer roller 20, in this embodiment, comprises a core metal 21 in the form of a pipe, and a resistance layer 22 on the outer surface of the core metal 21. The resistance layer 22 comprising aramide resin, polycarbonate or fluorine resin material and fine carbon or metal powder uniformly dispersed therein so that the volume resistivity thereof is $10^7$–$10^{10}$ ohm.cm.

The peripheral length of the intermediate transfer roller 20 is selected so as to be slightly larger than the length of the transfer sheet 24. In this embodiment, the transfer sheet 24 having the A4 size can be longitudinally fed, and therefore, the outside diameter of the roller 20 is 100 mm (peripheral length of 314 mm). The resistance layer 22 has a thickness of 100 microns.

The transfer roller 25 comprises a core metal and an elastic layer 27 formed on the peripheral surface thereon, the elastic layer 27 comprising carbon dispersed EPDM foamed material having a volume resistivity of approx. $10^9$ ohm.cm. The hardness thereof is not more than 40 degrees (Asker C).

The sequential superposing transfer operations for the first to fourth colors from the photosensitive drum 1 onto the intermediate transfer roller 20, are the same as in the case of FIG. 1, and the core metal 21 of the intermediate transfer roller 20 is supplied with a transfer bias voltage of +2–+5 KV of the polarity (+) opposite from that of the toner from the bias voltage source 61.

In this embodiment, during the transfer process, the transfer roller 25 is spaced (non-contact) from the intermediate transfer roller 20, thus preventing disturbance of the toner image on the intermediate transfer roller 20.

Designated by a reference numeral 8 is a cleaning device for the intermediate roller 20, and it is kept out of contact with the intermediate transfer roller 20 when the intermediate transfer roller carries the toner image.

The peripheral speed of the intermediate transfer roller 20 at the nip N is approx. 0.5% higher than the peripheral speed of the photosensitive drum 1 at the nip N. By doing so, the toner image is efficiently transferred from the photosensitive drum 1 onto the intermediate transfer roller 20, so that the central-image drop-out can be prevented.

For the transfers of the first to fourth color toner images onto the transfer material 24 from the intermediate transfer roller 20, the transfer roller 25 is brought into contact with the intermediate transfer roller 20 prior to the leading edge of the toner image on the intermediate transfer roller 20, and the core metal 26 of the transfer roller is supplied with a transfer bias voltage of the polarity (+) the same as that of the toner, from a bias voltage source 28.

Subsequently, the transfer material 24 enters the nip n between the intermediate transfer roller 20 and the transfer roller 25, so that the toner image is transferred from the intermediate transfer roller 20 to the transfer material 24.

The proper voltage of the transfer bias to the core metal of the transfer roller 25 depends on the transfer voltage applied to the core metal 21 of the intermediate transfer roller 20.

More particularly, the transfer bias voltage to the core metal 26 of the transfer roller 25 is preferably 2–4 KV higher in absolute value than the transfer bias voltage applied to the core metal 21 of the intermediate transfer roller 20, since then proper image transfer can be accomplished.

Since the voltage applied to the core metal 21 of the intermediate transfer roller 20 is +500 V when the toner image is transferred from the intermediate roller 20 to the transfer material 24 in this embodiment, the voltage applied to the core metal 26 of the transfer roller 25 is selected to be 3 KV.

In this embodiment, the peripheral speed at the nip of the transfer roller 25 is 0.5% higher than that of the peripheral speed of the intermediate transfer roller 20 at the nip, so that the conveying speed of the transfer material 24 is higher than the peripheral speed of the intermediate transfer roller 20. By doing so, the transfer of the toner image from the intermediate transfer roller 20 to the transfer material 24 is efficiently carried out with prevention of the central dropout.

Therefore, the central dropout can be prevented in the transfer from the photosensitive drum onto the transfer material 24 through the intermediate transfer member 20.

In this embodiment, the toner image on the photosensitive drum 1 is expanded approx. by 1.5% on the transfer material 24 in the sheet conveyance direction. However, this can be compensated by adjusting magnification upon the formation of the latent image on the photosensitive drum, that is, the latent image is formed with reduction of 1.5%.

Here, the description will be made as to the drop-out preventing effect using the peripheral speed difference in this embodiment. FIG. 9 shows a relationship between the degree of the central dropout of the transferred image and the peripheral speed of the intermediate transfer roller 20 at the nip when the peripheral speed of the photosensitive drum 1 at the nip N is 100. As will be understood from this Figure, the degree of the central dropout is improved by the peripheral speed difference. It is considered that the shearing force pending to wipe out the toner image by the peripheral speed difference is effective to improve the transfer efficiency. The same tendency exists in the transfer from the intermediate transfer roller 20 and the transfer material 24. In this embodiment based on the results, the peripheral speed of the intermediate transfer roller 20 is made higher by 0.5% than that of the photosensitive drum 1, the peripheral speed of the transfer roller 25 is made higher by 0.5% than that of the intermediate transfer roller 20, and it has turned out that the proper image transfer is possible.

EMBODIMENT 6

This embodiment is similar to Embodiment 5 (FIG. 8), but the peripheral speed of the intermediate transfer roller 20 is lower by 1% than that of the photosensitive drum, and the peripheral speed of the transfer roller 25 is higher by 0.5% by the intermediate transfer roller 20. By doing so, the central dropout can be prevented both in the transfer from the photosensitive drum to the intermediate transfer roller and in the transfer from the intermediate transfer roller to the transfer material. In addition, the peripheral speed differences compensate with each other the magnification change in the sheet moving direction.

More particularly, the toner image on the photosensitive drum 1 is reduced by 1% on the intermediate transfer roller 20 by the image transfer. When the image is transferred onto the transfer material 24, the transfer roller 25 is rotated at a speed higher by 1.5%, the transfer material 24 is advanced at a speed approx. 1% higher than the peripheral speed of the intermediate transfer roller 20 between the intermediate transfer roller 20 and the transfer roller 25 providing a larger friction force. In combination, the image on the transfer material 24 has the same size as that on the photosensitive drum 1. Because of the compensating function, a relatively large peripheral speed difference can be provided, and therefore, the central dropout preventing effect can be enhanced accordingly.

EMBODIMENT 7

(FIG. 10)

Figure 10:
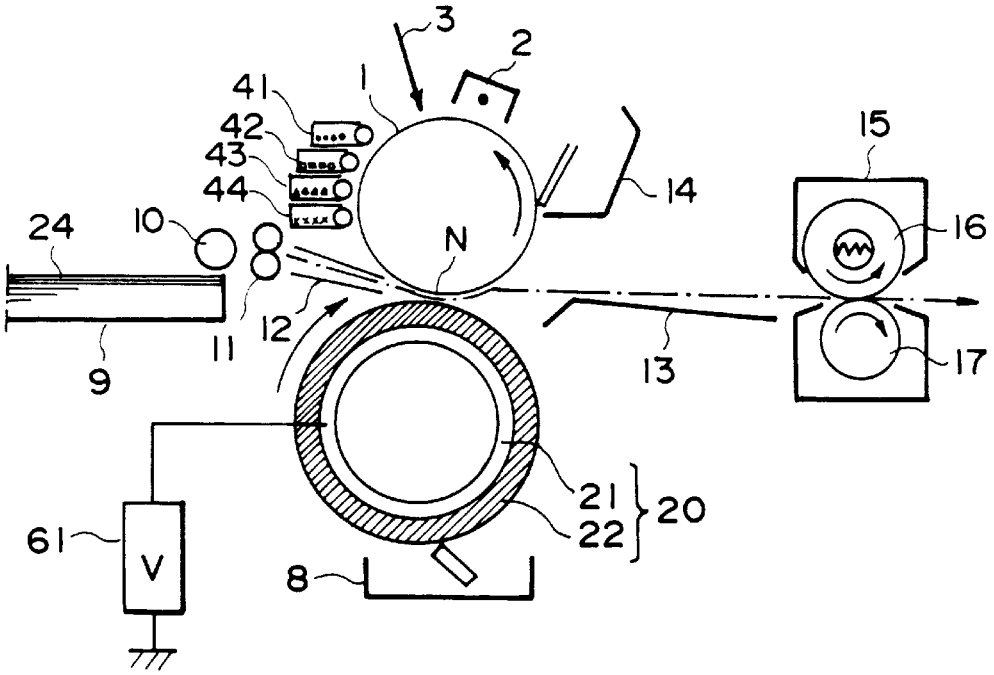
FIG. 10 is a sectional view of an image forming apparatus according to a seventh embodiment of the present invention.

FIG. 10 shows an image forming apparatus according to Embodiment 7, in which the toner image transfer onto the transfer material 24 is effected in the transfer nip N formed between the photosensitive drum 1 and the intermediate transfer roller 20. This embodiment is similar to the second embodiment (FIG. 2).

As shown in FIGS. 3 and 4, the apparatus is operable in a transfer mode for the four color toner image transfer from the intermediate transfer roller 20 to the transfer material 24, and a direct transfer mode for a monochromatic toner image transfer from the photosensitive drum 1 to the transfer material 24.

The elastic layer 22 of the intermediate transfer roller 20 has a volume resistivity of $10^7$–$10^{10}$ ohm.cm.

In this embodiment, the intermediate transfer member is in the form of an elastic roller 20, so that the feeding of the transfer material 24 by the transfer nip N is possible to realize the size reduction of the apparatus. If the peripheral speed of the intermediate transfer roller 20 at the nip N is made lower by 0.5% than that of the peripheral speed of the photosensitive drum 1, the speed difference is provided also between the intermediate transfer roller 20 and the transfer material 24, so that the central dropout in the transfer from the photosensitive drum to the intermediate transfer member and from the intermediate transfer member to the transfer material. This is effective in the case of monochromatic transfer, but it is particularly preferable in the case of the four color transfer operation since the expansion or enlargement of the image can be reduced.

This embodiment can be modified so that the peripheral speed of the intermediate transfer member is changed depending on the operational mode, that is, depending on whether four color images are transferred onto the intermediate transfer member or an image is transferred to the transfer material, so as to prevent the central drop-out and to increase the printing accuracy.

For example, the peripheral speed of the intermediate transfer roller 20 is 0.5% lower than that of the photosensitive drum 1 during the intermediate transfer operation and is higher by 1% during the transfer to the transfer material. By doing so, for the same reasons as described in conjunction with Embodiment 6, the image on the transfer material 24 has the same size as that on the photosensitive drum 1. In addition, the peripheral speed difference from the sheet feeding speed of the transfer material 24 during the transfer operation can be sufficiently provided, and therefore, the central drop-out preventing effect is enhanced.

EMBODIMENT 8

(FIG. 11)

Figure 11:
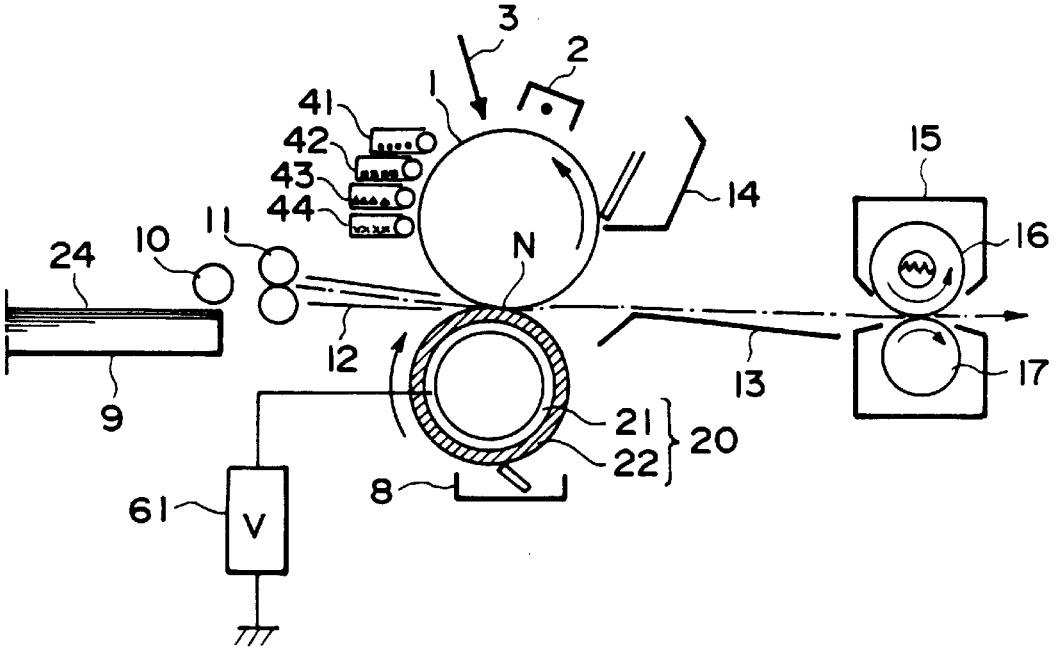
FIG. 11 is a sectional view of an image forming apparatus according to an eighth embodiment of the present invention.

FIG. 11 shows an image forming apparatus according to Embodiment 8. In this embodiment, in comparison with the apparatus of the seventh (FIG. 10) embodiment, the outside diameter of the intermediate transfer roller 20 is small.

More particularly, in this embodiment, the peripheral length of the intermediate transfer roller 20 is shorter than the length of the transfer material 24 by utilizing to the advantage the expansion and reduction of the image in the transfer from the photosensitive drum 1 to the intermediate transfer material 20 and in the transfer from the intermediate transfer member 20 to the transfer material 24 providing the speeds differences.

Furthermore, the peripheral speed of the intermediate transfer roller 20 is 50% of that of the transfer drum 1 during a four color intermediate transfer operation, by which the central drop-out is prevented, and allowing reduction of the size of the image on the intermediate transfer roller 20.

When the image is to be transferred onto the transfer material 24, the transfer material 24 is supplied into the transfer nip N by registration rollers 11 at the same peripheral speed as the photosensitive drum 1, and the toner image is expanded to the original size. At this time, between the transfer material 24 and the intermediate transfer roller 20, there is a speed difference during the intermediate transfer, and therefore, the central drop-out can be prevented.

Generally speaking, when the intermediate transfer member is in the form of a roller 20, the peripheral length of the roller 20 is preferably longer than the length of the transfer material 24. According to this embodiment, it becomes possible to use an intermediate transfer roller 20 having a peripheral circumferential length which is one half the length of the transfer material 24. In other words, the diameter thereof can be reduced to one half, thus permitting size reduction of the apparatus.

In the case of A4 size sheet feeding, the intermediate transfer roller 20 is normally required to have 100 mm diameter. This means difficulty in the separation. According to this embodiment, however, the diameter of the intermediate transfer roller 20 can be reduced to 50 mm, and therefore, the large curvature thereof permits easy separation of the transfer material, and therefore, the malfunction in the sheet conveyance such as jam can be prevented.

As described in the foregoing, after the image formed on the first image bearing member is transferred onto the intermediate transfer member at a first transfer position, it is further transferred onto a second image bearing member at a second transfer position. In such an image forming apparatus, according to the above-described embodiments, the surface movement speed of the intermediate transfer member at the first transfer position is made different from the surface moving speed of the first image bearing member at the first transfer position, so that the central transfer failure (drop-out) can be prevented. In addition, by the difference between the surface movement speed of the intermediate transfer member and the surface moving speed of the second image bearing member at the second transfer position, the transferred image is free from the central drop-out. In this case, the intermediate transfer member may be in the form of a belt as shown in FIG. 21.

EMBODIMENTS 9–11

Which will be described hereinafter are concerned with improvements in the apparatus using an intermediate resistance roller as the intermediate transfer member, as in the first–eighth embodiments.

(1) The intermediate elastic layer 22 of the intermediate transfer member 20 has a controlled resistance which has been controlled by dispersing carbon or metal oxide or the like in an elastic material. Such an intermediate resistance elastic layer 22 may have varying resistance due to the manufacturing tolerance or ambient condition change. It is desirable the intermediate transfer operation is carried out with stability even when the resistance of the intermediate elastic layer 22 varies.

In the case of a constant voltage control in which a constant voltage is supplied to the intermediate transfer roller 20 during the transfer operation to the intermediate transfer member 20, sufficient current does not flow to the photosensitive drum 1 when the resistance of the intermediate transfer member 20 is high under the low humidity condition, and therefore, it is not possible to sufficiently transfer the toner image from the photosensitive drum 1 onto the intermediate transfer member with the result of improper image transfer. On the contrary, under the high humidity condition, if the resistance,of the intermediate transfer member 20 decreases, too much current flows into the photosensitive drum 1 with the result of drum memory, and back transfer of the toner image in which the transferred toner is transferred back to the photosensitive drum.

Because the optimum transfer voltages for the first, second, third and fourth toner images are different, the result is difficulty in the control system.

(2) Under a high humidity condition, the resistance of the intermediate transfer member 20 decreases, and in addition, the resistance of the transfer member 24 significantly decreases, and the optimum transfer voltage varies when the image is transferred from the intermediate transfer member 20 onto the transfer material 24.

For these reasons, a transfer voltage which is proper under the normal humidity condition is too high under the high humidity condition under which the resistance of the transfer material 24 greatly decreases with the result that the transfer current flows through the thickness of the transfer material, or that the transfer current does not flow sufficiently in the toner present area of the intermediate transfer member 20, so that the transfer current is concentrated on such areas as not having the toner. If this occurs, the image may scatter.

These problem do not easily arise when the resistance of the intermediate transfer member 20 is relatively high, because the entire resistance including the photosensitive drum 1, the intermediate transfer member 20, and the transfer material is not easily influenced by the resistance of the transfer material 24. However, when the resistance of the intermediate transfer member 20 is high, the entire resistance is significantly influenced by the resistance change of the transfer material 24. Particularly, under the high humidity and high temperature condition, the resistance of the intermediate transfer member 20 tends to decrease to ½–⅓. This is a main cause of promoting the above phenomenon.

(3) In an image forming apparatus capable of a automatic duplex image forming function or a superposing image forming function, the image transfer for the first surface (or first image) on the transfer material 24 is carried out, and the transferred image is fixed, by which the moisture is removed from the transfer material 24 so that a high resistance state arises.

When the transfer material 24 is supplied to the transfer station for the purpose of the image transfer on the second surface (second image), the resistance of the transfer material 24 is high. Therefore, upon the image transfer on the second surface (second image) in good order, a transfer voltage which is higher than the transfer voltage capable of providing proper transfer for the first surface (first image), is desired. The Embodiments 9–11 are related to the solution to these problems in the apparatus using the intermediate resistance roller as the intermediate transfer member.

EMBODIMENT 9

(FIG. 12)

Figure 12:
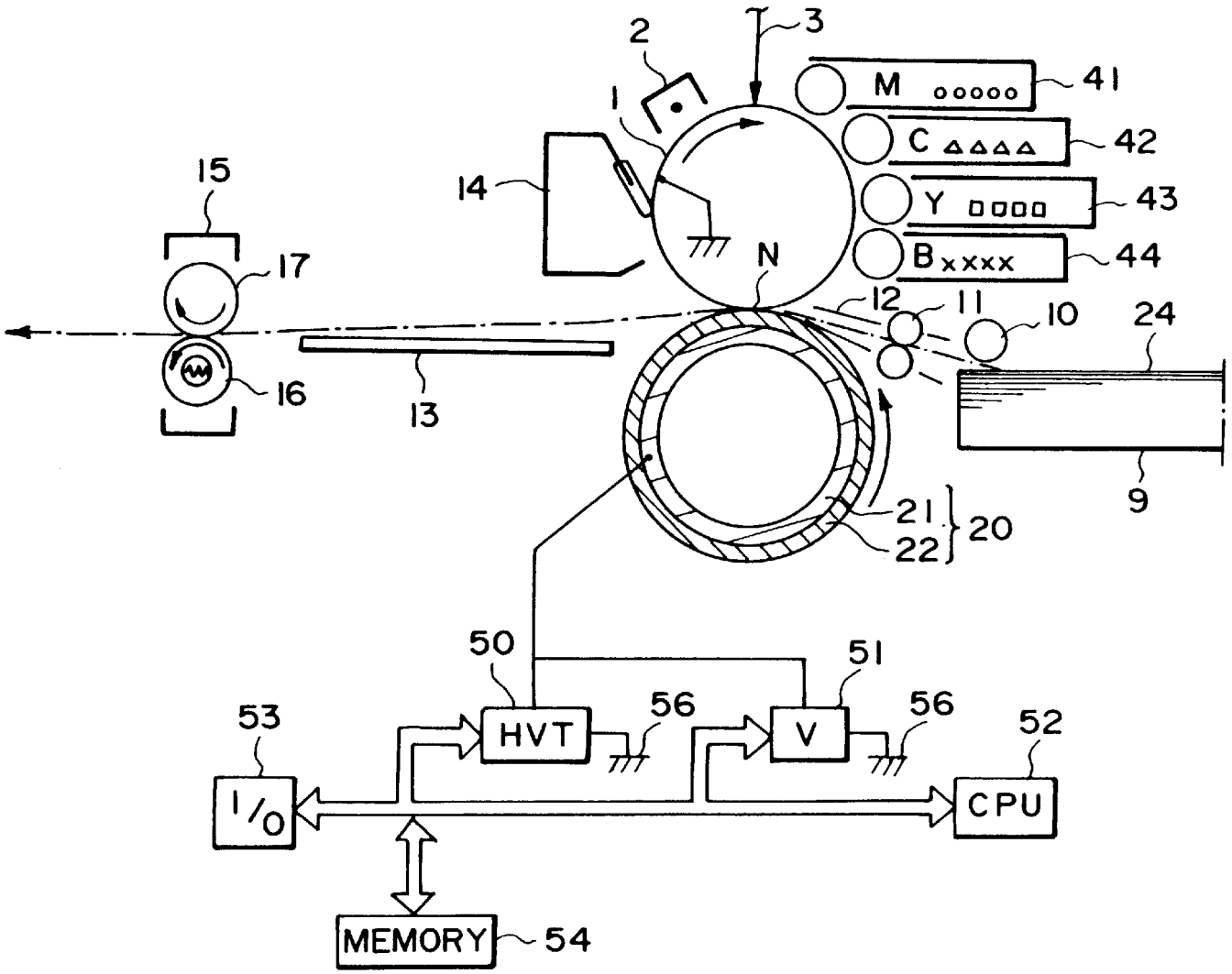
FIG. 12 is a sectional view of an image forming apparatus according to a ninth embodiment of the present invention.

FIG. 12 shows an image forming apparatus according to Embodiment 9 of this invention. The structure thereof is similar to that of the second embodiment (FIG. 2).

The intermediate transfer roller 20 as the intermediate transfer member comprises a core metal 21 in the form of a pipe and an elastic layer 22 formed thereon, the elastic layer 22 comprises an elastic material of EPDM or the like and fine carbon or metal powder uniformly dispersed therein so that the volume resistivity thereof is $10^5$–$10^{11}$ ohm.cm. The circumferential length of the intermediate transfer roller 20 is slightly larger than the length of the transfer material 24. In this embodiment, the transfer material 24 having an A4 size is longitudinally fed, and therefore, the intermediate transfer roller 20 has an outer diameter of 100 mm (circumferential length of 314 mm), and the thickness of the elastic layer 22 is 8 mm. The hardness thereof is 30–50 degrees (Asker C).

More particularly, the process speed is 90 mm/sec, and the diameter of the photosensitive drum 1 is 30 mm.

Designated by a reference numeral 50 is a bias source for an intermediate transfer roller 20. The bias voltage source 50 may be in the form of a constant current source or a constant voltage source. In addition, the polarity is changeable.

Designated by a reference numeral 51 is a bias voltage detecting means for the intermediate transfer roller 20; 52 is a CPU; 53 is I/O port; 54, memory; and 56, ground.

The control operation of the apparatus in this embodiment will be described.

(1) The sequential control operation is carried out using the CPU 52, and to the core metal 21 of the intermediate transfer roller 20, a voltage $V_{t0}$ is applied to provide a constant electric current I=4 $\mu$A, and the intermediate transfer roller 20 is constant-current-controlled, during which the toner image is transferred from the photosensitive drum 1 to the intermediate transfer roller 20.

With the advancement of the transfer from the first color to the fourth color, the amount of the toner on the intermediate transfer roller 20 increases, and therefore, the voltage $V_{t0}$ increases. Even within the first color image, the voltage $V_{t0}$ changes depending on the amount of the toner. At this time, the voltage $V_{t0}$ has a polarity which is opposite from that of the toner.

(2) Accordingly, the entire color image most suitably reflects the resistance at the time when the fourth toner image is being transferred. During the fourth color transfer, the transfer voltage $V_{t0}$ is measured during a constant current bias control operation, and the average of the transfer voltage $[V_{t0}]$ during the fourth color transfer is used as a voltage $V_T$ for the control operation.

(3) A proper transfer voltage V corresponding to the measured voltage $V_T$ in accordance with a transfer voltage calculating equation (A) with a being a predetermined al and b being a predetermined value b1, as follows:

$$|V|=a|V_T|+b \quad \text{(A)}$$

When the toner image is transferred from the intermediate transfer roller 20 onto the transfer material 24, the intermediate transfer roller 20 is constant-voltage-controlled at the calculated transfer voltage V, and the toner transfer onto the transfer material 24 is carried out with the voltage. At this time, the transfer voltage V has the same polarity as the toner.

More particularly, when the constants a and b are set to a1=1.0 b1=1.2 proper image transfer operation was performed.

The constant b in the equation (A) is added in consideration of a voltage drop due to the transfer material resistance in the transfer operation (sheet passage).

EMBODIMENT 10

The image forming apparatus itself of this embodiment is the same as the ninth embodiment. However the controlling operation is different as follows.

(1) The sequential control operation is carried out under the control of CPU 52, and to the core metal 21 of the intermediate transfer roller 20, a voltage $V_{t0}$ capable of supplying a constant current of I=4 $\mu$A is applied. The toner image is transferred from the photosensitive drum 1 onto the intermediate transfer roller 20 while constant-current controlling the current to the intermediate transfer roller 20.

With the advancement of the transfer process from the first color to the fourth color, the amount of the toner on the intermediate transfer roller 20 increases, and the voltage $V_{t0}$ increases. Even within one color image, the voltage $V_{t0}$ changes with amount of the toner. At this time, the voltage $V_{t0}$ has a polarity which is opposite from that of the toner.

(2) Therefore, the resistance of the entire color image is most suitably reflected when the fourth color toner image is being transferred. The transfer voltage $V_{t0}$ during the constant current bias control at this time is measured, and the average $[V_{t0}]$ is used as the controlling voltage $V_T$.

(3) The measured voltage $V_T$ is compared with a predetermined reference voltage (discriminating voltage) V1.

When $|V_T| \geqq V1$ as a result of comparison, a usual control is carried out. That is, similarly to Embodiment 9, the proper transfer voltage V corresponding to the measured voltage $V_T$ is calculated in accordance with the transfer voltage calculating equation (A) with the constants a and b being predetermined values a1 and b1, respectively.

When the toner image is transferred from the intermediate transfer roller 20 onto the transfer material 24, the intermediate transfer roller 20 is constant-voltage-controlled with the calculated transfer voltage V so as to transfer the toner image onto the transfer material 24. The transfer voltage V at this time has the same polarity as the toner.

(5) However, if $|V_T|<V1$ in (4), it is determined that the resistance of the intermediate transfer member 20 decreases under a high humidity condition, and simultaneously, the resistance of the transfer material 24 deceases. Therefore the transfer current may more easily penetrate through the thickness of the transfer material during the transfer operation, or the toner scattering may occur more easily due to the too large transfer current. Accordingly, the constants a and b are changed to a2 and b2 so as to provide a smaller voltage V by the transfer voltage calculating equation (A). Then, the proper transfer voltage V corresponding to the measured voltage $V_T$ is calculated in accordance with the transfer voltage calculating equation (A) with the constants a and b being a2 and b2, respectively.

When the toner image is transferred from the intermediate transfer roller 20 onto the transfer material 24, the intermediate transfer roller 20 is constant-voltage-controlled at the calculated transfer voltage V, and the toner image transfer onto the transfer material 24 is executed. Here, the transfer voltage V has the same polarity at the toner.

More particularly, the reference voltage V1 is 1 KV, and the constants a and b in the equation (A) are as follows:

a1=1.0 b1=1.2 a2=2.2 b2=0

By doing so, when the absolute value of the measured voltage $V_T$ is higher than 1 KV (=V1) the calculation of the proper transfer voltage V, the constant voltage control for the intermediate roller with the calculated voltage V during the image transfer from the intermediate transfer member 20 to the transfer material 24, as stated in (4) above.

When the measured voltage $V_T$ is not more than 1 KV, the calculation of the proper transfer voltage V for providing lower transfer voltage, and the constant voltage control operation for the intermediate transfer roller 20 with the calculated voltage V during the transfer operation are carried out.

When the measured voltage $V_T$ is 1 KV, $a1|V_t|+b1=a2|V_T|=b2$.

Therefore, the continuity of the control voltage is maintained, but the continuity is not inevitable. In addition, the voltage which becomes a discrimination reference for the constants a and b, is not limited to only one voltage V1, but a plurality of such voltages are usable.

In the transfer voltage calculating equation (A), the constant b is added in consideration of a voltage drop due to the resistance of the transfer material during the transfer operation (sheet passage period).

Therefore, when the transfer material resistance decreases due to moisture absorption of the transfer material 24 under the high temperature and high humidity condition, the proper transfer voltage V can be provided by decreasing the constant b.

EMBODIMENT 11

(FIG. 13)

Figure 13:
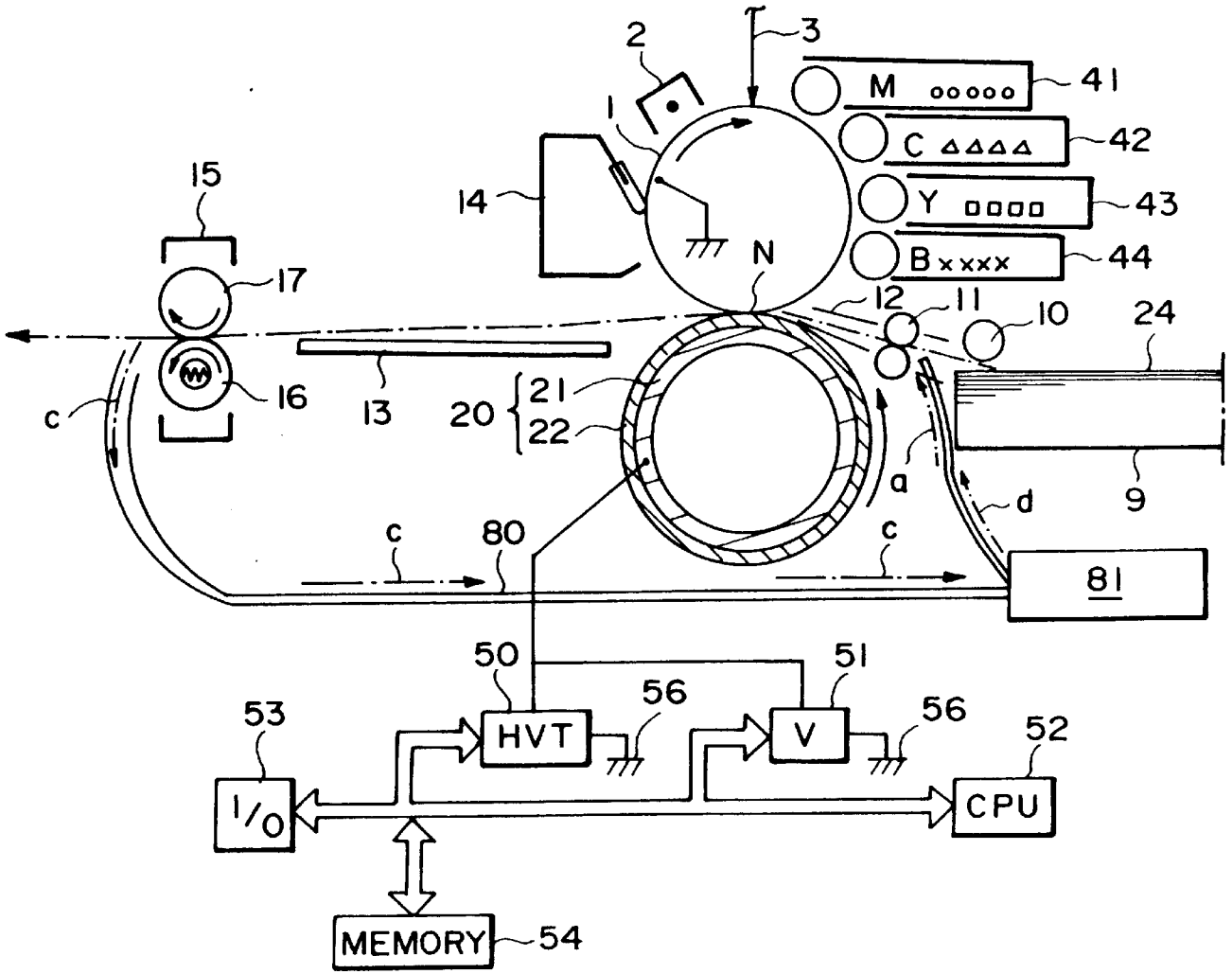
FIG. 13 is a sectional view of an image forming apparatus according to an eleventh embodiment of the present invention.

FIG. 13 shows an image forming apparatus according to Embodiment 11 of this invention. The apparatus of this embodiment is similar to the apparatus of the ninth embodiment (FIG. 12).

After the toner image is transferred from the photosensitive drum 1 onto the intermediate transfer roller 20, the transfer material 24 is supplied into the transfer nip N between the photosensitive drum 1 and the intermediate transfer roller 20 to receive the toner image on the first surface. It is then subjected to the image fixing operation in the fixing device 15. Thereafter, the transfer material 24 is fed back by a reversing device 81 of a refeeding device 80 mounted at the bottom of the image forming apparatus, along a passage indicated by an arrow c. Thus, the transfer material 24 is introduced to the transfer guide 12 along the passage d. It is then fed into the transfer nip N between the photosensitive drum 1 and the intermediate transfer roller 20, and the image transfer operation is carried out on the second surface of the transfer roller 24. When the operation of the reversing device 81 is deactivated the transfer material 24 is not reversed, and the superposing transfer is carried out.

In such an apparatus, as described hereinbefore, the transfer material 24 already having the first side image transferred thereto and being refed into the transfer nip N for the transfer on the second surface, has been dried by the heat in the fixing device during the first side image fixing, so that the resistance of the transfer material 24 is higher than during the first side image transfer.

Under the high humidity condition, the resistance of the transfer material 24 during the first side image transfer is low. In the first side image transfer operation, as described in conjunction with Embodiment 10, the transfer voltage is preferably lowered since otherwise improper image transfer occurs due to the too high transfer voltage. In other words, there is no condition which satisfies both the first side image transfer and the second side image transfer.

In such a case, the constants a and b in the transfer voltage calculating equation (A) are determined in consideration of the difference between the first side transfer and the second side transfer for the transfer material 24.

The second side image formation is carried out by the refeeding mechanism 80 after formation of the image on the first surface through the processes (1)–(5) in Embodiment 10.

(6) The proper transfer voltage V corresponding to the measured voltage $V_T$ is calculated in accordance with the transfer voltage calculating equation (A) with the constants a and b being predetermined values a3 and b3, for the second side image formation mode.

When the toner image is transferred from the intermediate transfer roller 20 onto the transfer material 24, the intermediate transfer roller 20 is constant-voltage-controlled with the calculated transfer voltage V, and the second image is transferred onto the second surface of the transfer material 24. At this time, the transfer voltage V has the same polarity as the toner.

With the control explained in (6), the toner can be properly transferred both in the duplex transfer and the superposing transfer.

More particularly, the control operation has been carried out under the following conditions:

(a) Reference voltage V1 for the comparison is 1.0 KV (b) The constants a and b of the transfer voltage calculating equation (A) in the first side image forming mode when $|V_T| \geqq V1$:

a1=1.0 b1=1.0

(c) The constants a and b in the transfer voltage calculating equation (A) in the first side image formation mode when $|V_T| < V1$:

a2=2.2 b2=0

(d) The constants a and b of the transfer voltage calculating equation (A) for the second side image formation mode in the both side image formation (duplex).

As a result, even if the resistance of the transfer material 24 is low under the high humidity condition, the constants a=a2 and b=b2 for the image transfer onto the first side of the transfer material 24, and similarly to the Embodiment 10, the scattering or the current penetration due to the too high transfer voltage can be prevented.

For the image transfer onto the second side of the transfer material having a high resistance because of the drying effect during the fixing operation for the first side transferred image, the constants a=a3, b=b3 against the improper transfer due to the insufficient transfer current due to the high resistance of the transfer material 24, the transfer voltage without the improper transfer can be provided.

The constant b in the equation (A) is added in consideration of the voltage drop due to the transfer material resistance in the transfer (sheet passage). Therefore, when the transfer material resistance is increased by the drying effect of the fixing device 15, the transfer voltage V can be optimized by increasing the constant b.

The above-described Embodiments 9, 10 and 11 are not limited to the improvements in the transfer performance under the above-described high humidity condition, but they are usable for optimizing the transfer performance under the normal humidity or low humidity conditions.

According to an image forming apparatus according to Embodiments 9, 10 or 11, the image formed on the first image bearing member is transferred onto an intermediate transfer member comprising an intermediate resistance roller, and is further transferred onto a second image bearing member. Even when the resistance of the intermediate transfer member and/or the resistance of the transfer material significantly changes in accordance with ambient condition change, an optimum transfer property can be provided by the application of a constant current bias voltage to the intermediate transfer member when the image is transferred onto the intermediate transfer member on the first image bearing member. When the image is transferred from the intermediate transfer member to the transfer material, the proper transfer property can be provided by application of an optimum voltage to the intermediate transfer member. Furthermore, during the both side and superimposing image transfer processes there is no difference between the first surface (first image transfer) and the second surface (second image formation), so that the stabilized transfer property can always be provided.

In Embodiments 12, 13 and 14 which will be described hereinafter, the separation of the transfer material from the transfer nip is made easier during the discharging, and the image disturbance during the transfer is prevented.

EMBODIMENT 12

(FIGS. 18–20)

Figure 18:
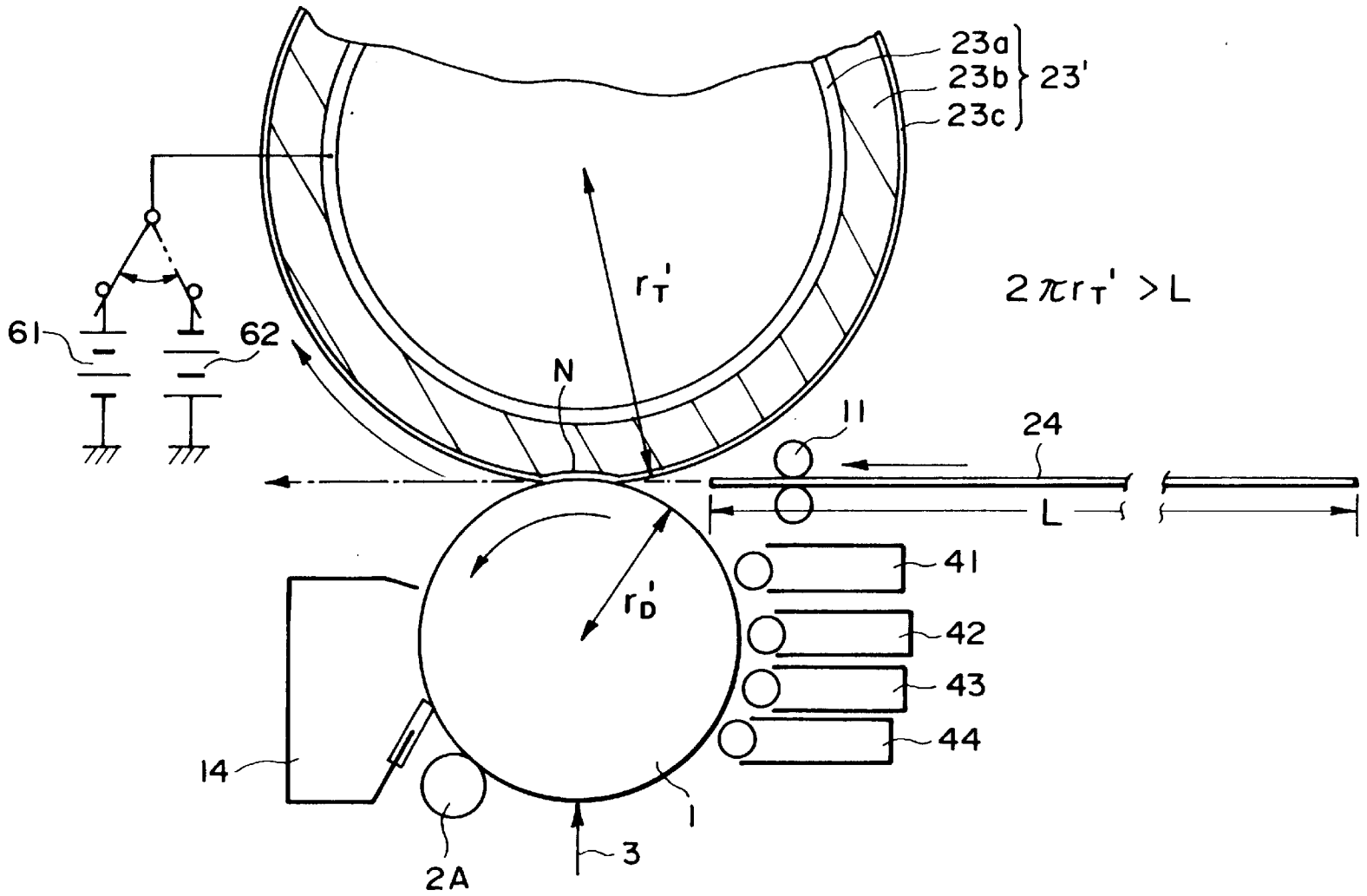
FIG. 18 is a sectional view of an image forming apparatus according to a 12th embodiment.
Figure 19:
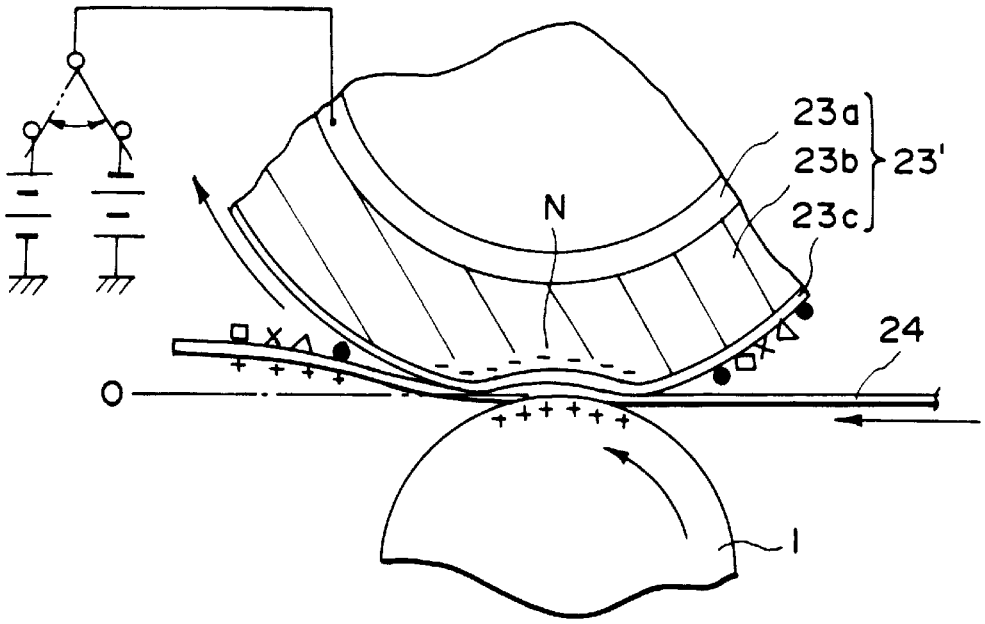
FIG. 19 illustrates an image transfer process from an intermediate transfer roller to a transfer material for formation of a combined color toner image.
Figure 20:
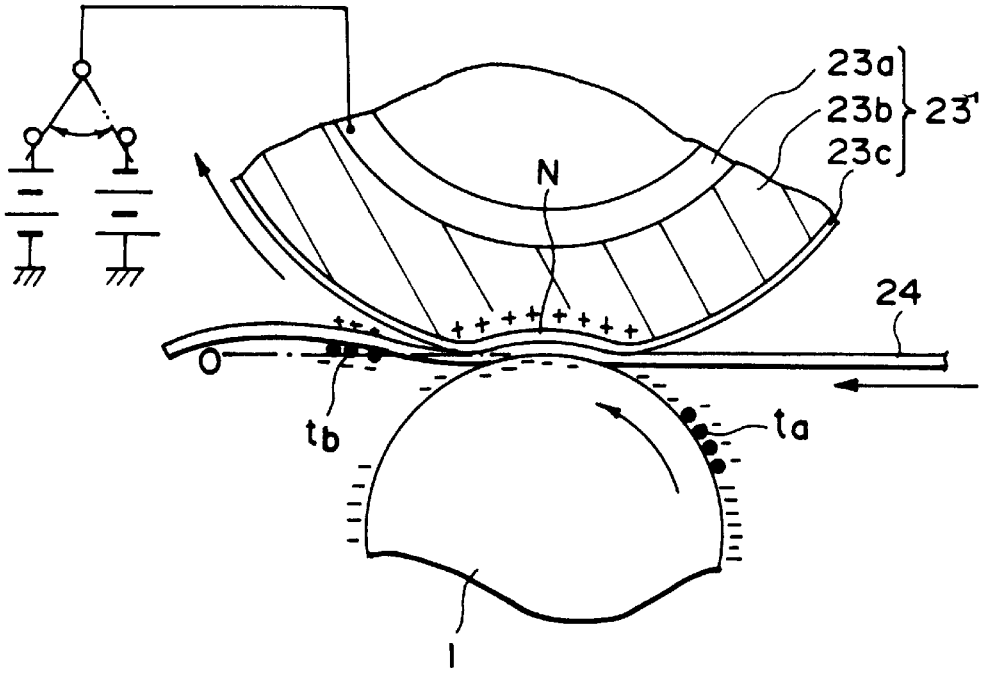
FIG. 20 schematically illustrates an image transfer process in the case of a monochromatic print.

FIG. 18 shows an image forming apparatus according to Embodiment 12.

In the embodiment of this apparatus, the transfer roller 23' functions also as an intermediate transfer member. Similarly to Embodiment 2 (FIG. 4), the image is transferred from the transfer roller 23' to the transfer material in the case of multi-color print; and in the case of monochromatic print; the image is directly transferred from the photosensitive drum 1 onto the transfer material.

The transfer roller 23' comprises a core metal 23*a*, an electrically conductive elastic layer 23*b* having a volume resistivity of $10^3$–$10^6$ ohm.cm, and an intermediate resistance thin layer 23*c* (volume resistivity of $10^7$–$10^{11}$ ohm.cm), so that an intermediate resistance elastic roller is constituted as a whole. A radius $r'_T$ satisfies $L<2\pi r'_T$ where length of the transfer material 23 is L.

The photosensitive drum 1 has a radius $r'_D$, and the curvature thereof is $1/r'_T<1/r'_D$ Similarly to the first embodiment (FIG. 1), the sequential toner image formations for the first to fourth colors on the photosensitive drum 1, and a sequential superposing transfer on the outer peripheral surface of the transfer roller 23' functioning as an intermediate transfer member of the toner image of the first to fourth colors, are carried out so that a combined color toner image is formed on the outer surface of the transfer roller 23'. Similarly to the above-described second embodiment (FIG. 2), the image transfer of the toner image transferred onto the outer peripheral surface of the transfer roller 23' onto the transfer material 24 is effected as follows. The transfer material 24 is supplied at the predetermined timing into the transfer nip N between the photosensitive drum 1 and the transfer roller 23' from a sheet feeding cassette, and a bias voltage of the same polarity (–) as the toner is applied to the core metal 23*a* of the transfer roller 23' from the second bias voltage source 62. FIG. 1 shows the transfer process.

The transfer material 24 discharged from the transfer nip N is attracted to the transfer roller 23' rather than to the photosensitive drum 1, and since the transfer material 24 tends to be convex up in the transfer nip N (when the transfer roller 23' is at the upper position), the leading edge of the transfer material 24 is separated from the transfer roller 23' by the rigidity, thus facilitating the separation action. Particularly when the diameter of the photosensitive drum exceeds 60 mm, improper separation tends to occur more frequently, and therefore, it is preferable to satisfy $1/r'_T<1/r'_D$ in this case.

The transfer roller 23' may transfer the toner image $t_a$ from the photosensitive drum 1 directly onto the transfer material 24 ($t_b$)by the transfer roller 23' during a monochromatic mode operation. For the same reason as described above, the separation of the transfer material 24 from the transfer nip N is easy.

EXPERIMENT 1

The photosensitive drum 1 is comprised of aluminum core metal and an organic photoconductive (OPC) with radius of 35 mm. It is driven at a peripheral speed of 100 mm/sec, and a latent image is formed, and sequentially color toner images are formed.

The black, magenta, cyan and yellow toners were non-magnetic and had a volume average particle size of 5–8 microns (one component toner). They are negatively chargeable toners having a specific charge amount of −8–−18 $\mu$c/gr, and the toner image was produced through a reverse development.

The transfer roller 23' comprised an aluminum core metal 23*a* having a radius of 40 mm and a foamed EPDM layer 23*b* in which carbon is dispersed to provide a volume resistivity of $10^3$ ohm.cm, and a PVdF layer 23*c* containing tin oxide and having a volume resistivity of $10^9$ ohm.cm. It was an intermediate resistance roller having a radius of 50 mm. The hardness of the transfer roller 23' is 35 degrees (Asker C) and was press-contacted to the photosensitive drum 1 with a total pressure of 1000 g including the weight of the transfer roller 23' itself to form the transfer nip N. The transfer material 24 was plain paper sheet of A4 size (L=297 mm) having a basis weight of 90 g/m$^2$.

When the toners of each color are transferred onto the intermediate roller, the core metal of the photosensitive drum 1 is grounded, and +1000 V is. added to the core metal 23*a* of the transfer roller 23'. When the color toner image is transferred from the transfer roller 23' onto the transfer material 24, −3000 V is applied to the core metal 23*a* of the transfer roller 23'.

In this manner, upon the separation of the transfer material 24 from the transfer nip N, good transfer image without image disturbance could be provided without deflection of the transfer material 24 toward the photosensitive drum 1.

Figure 14:
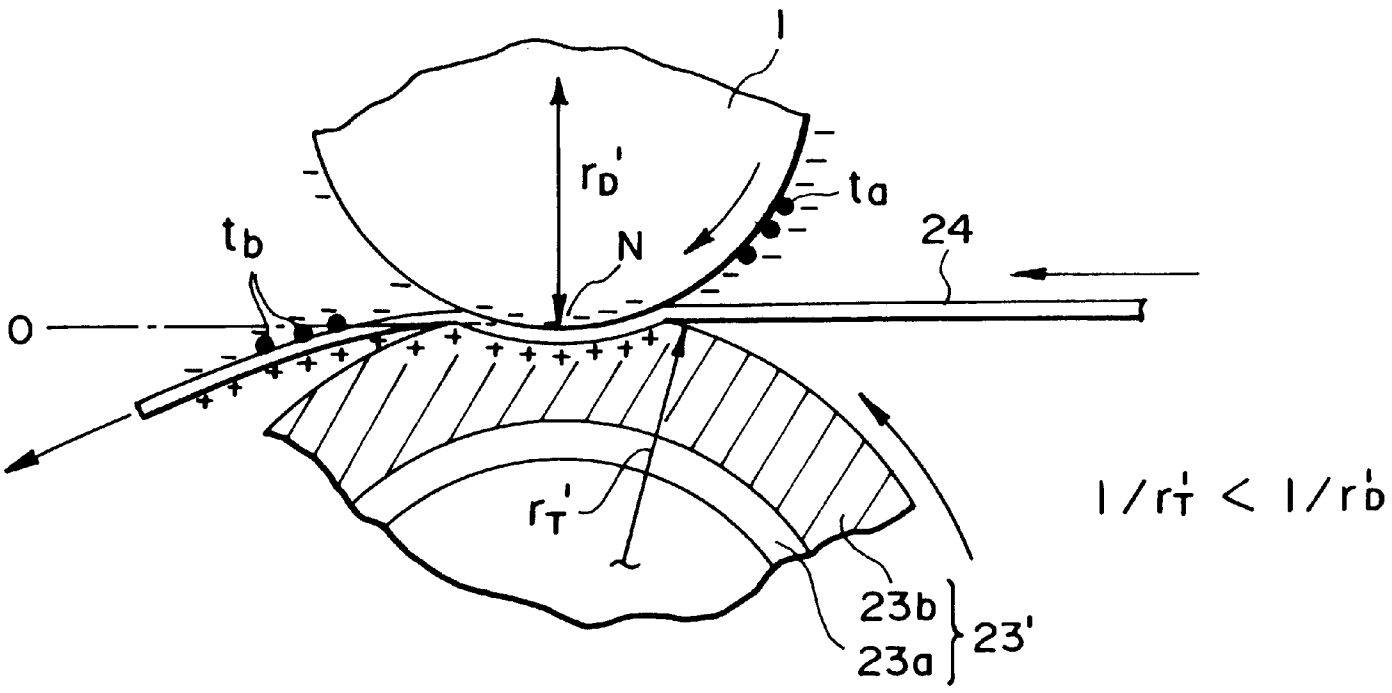
FIG. 14 is a sectional view of a major part of an image forming apparatus according to a twelfth embodiment of the present invention.

As shown in FIG. 14, the transfer roller 23' may comprise a core metal and one intermediate resistance elastic layer 23*b*. The curvature $1/r'_T$ of the transfer roller 23' is smaller than the curvature $1/r'_D$ of the photosensitive drum ($1/r'_T<1/r'_D$). When the transfer material 24 is discharged from the transfer nip N, the transfer material 24 receives mirror force toward the photosensitive drum 1 by the surface charge, and also attraction mirror force toward the transfer roller 23' due to the backside charge. As a result of the combination of these forces with the rigidity of the transfer material 24 itself tending to be away from either of the surfaces, results in separation with deviation toward the transfer roller 23' side having the smaller curvature.

In other words, the transfer material 24 moves along a line inclined from the transfer nip N toward the transfer roller 23' from a tangent line at the transfer nip N, so that the transfer material 24 does not rub the bottom of the cleaning device 14 (FIG. 18), or is not jammed.

The transfer material is attracted by the transfer roller 23' while discharged from the transfer nip N. However, in the transfer nip N, the elastic material transfer roller 23' is pushed to the rigid photosensitive drum 1, so that concave up nip is formed (when the photosensitive drum is at the upper position). When the leading edge of the transfer material 24 is discharged from the transfer nip N, such a force is applied that the leading edge is away from the surface of the transfer roller 23' by the rigidity of the transfer material 24 in the transfer nip N, and therefore, the transfer material 24 is prevented from being wrapped around the transfer roller 23'.

EMBODIMENT 13

Figure 15:
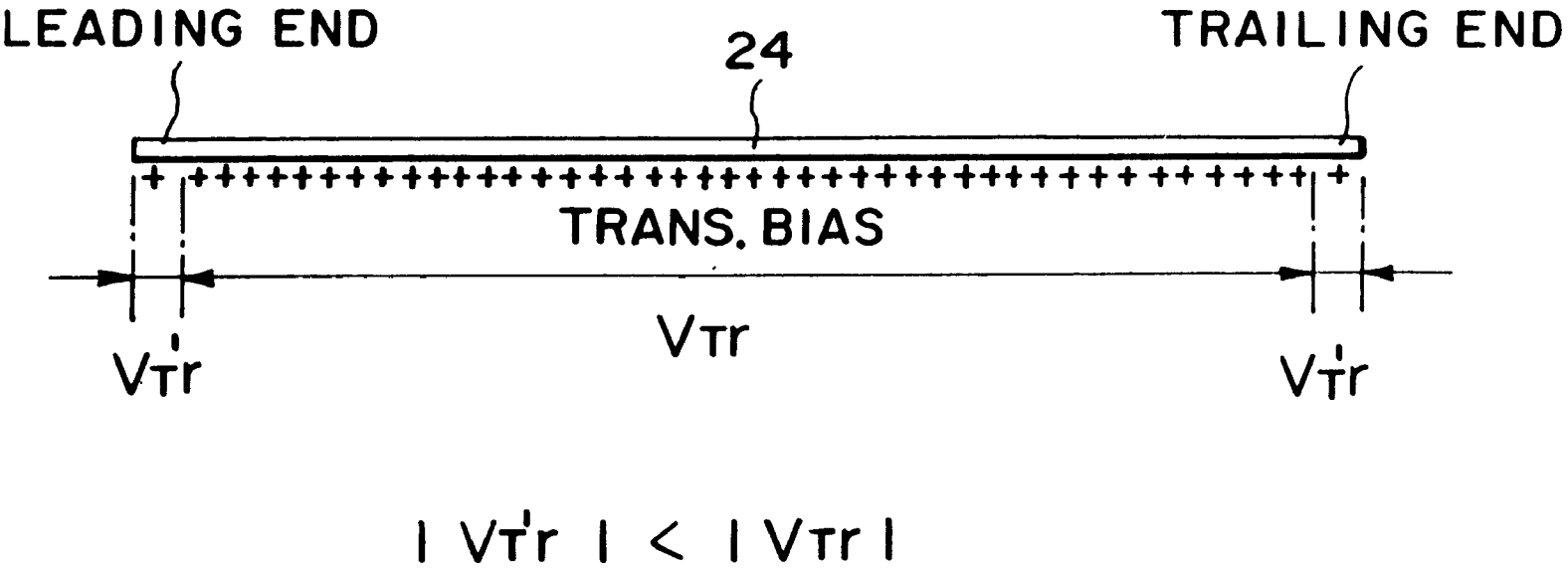
FIG. 15 illustrates results of control of a transfer bias voltage to a transfer material in the image forming apparatus according to the 13th embodiment.
Figure 16:
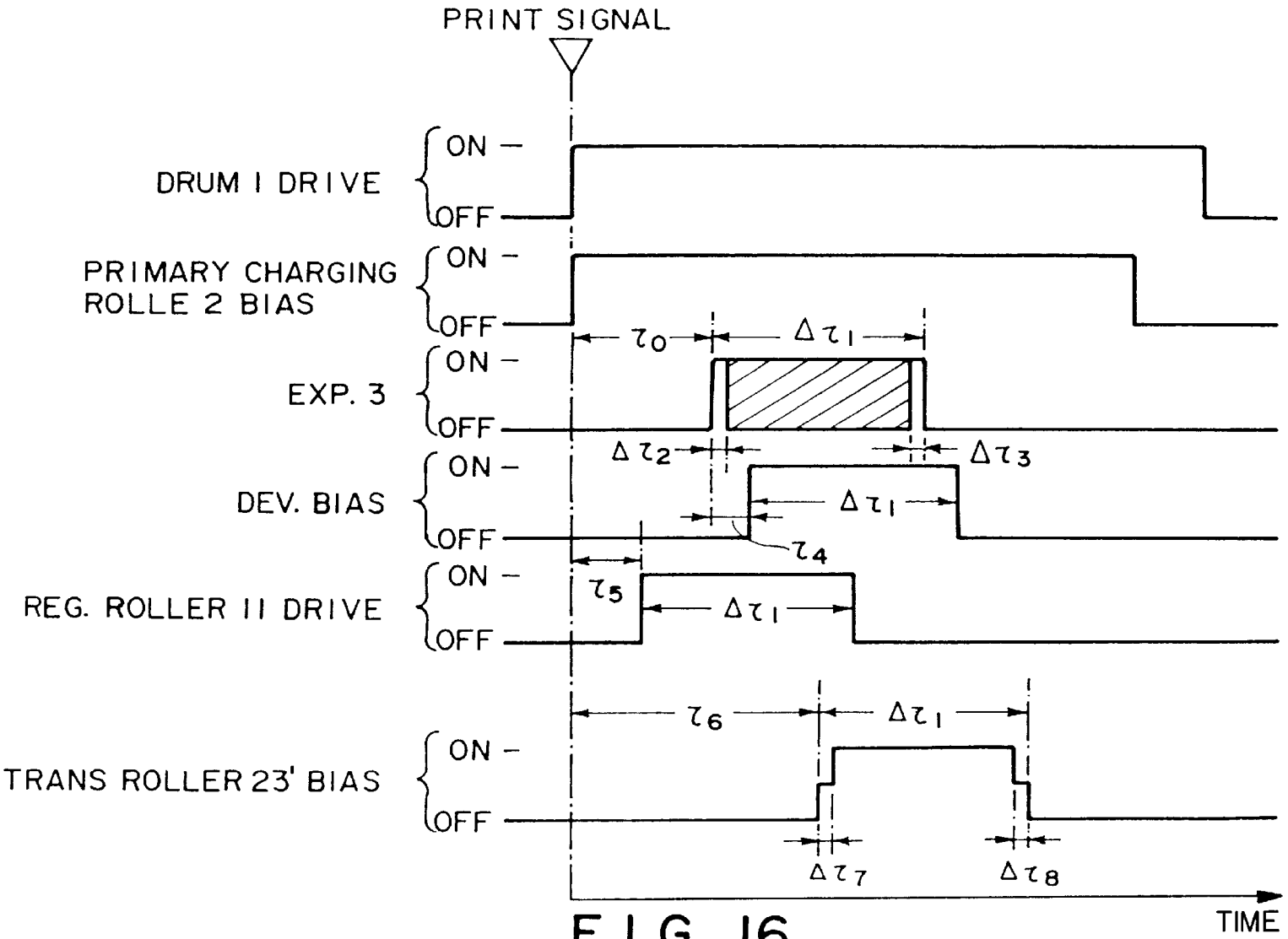
FIG. 16 shows a control sequence.

(FIGS. 15 and 16)

FIGS. 15 and 16 show the results of control of the transfer bias for the transfer onto the transfer material 24 and control sequence, in the apparatus of this embodiment.

Similarly to FIG. 14 embodiment, the transfer roller 23' has a smaller curvature $1/r'_T$ which is smaller than the curvature $1/r'_D$ of the photosensitive drum 1. In this embodiment, the absolute value of the transfer bias voltage at the leading or trailing edge of the transfer material 24 is reduced, by which the mirror force toward the photosensitive drum 1 and the transfer roller 23' is reduced at the time of the discharge of the transfer material 24 from the transfer nip N, by which the separation of the transfer material 24 is made smoother.

As shown in FIG. 16, when the print signal is transmitted from a host computer, the photosensitive drum 1 starts rotation, and simultaneously the charging of the primary charging roller 2 (FIG. 22) starts.

At the point of time $\tau_0$ when the surface potential of the photosensitive drum 1 is stabilized, scanning exposure by the laser starts. In the time period $\delta\tau_1$ corresponding to the length of the transfer material 24, the exposure is not effected during the leading end portion time $\delta\tau_2$ and the trailing end corresponding period $\delta\tau_3$, and therefore, the electrostatic latent image is not formed on the portions of the drum 1 corresponding to the leading and trailing end portions of the transfer material 24, whereby blanks are formed. The developing bias is applied to the developing device 4, so that developing operation is carried out. However, the developing bias is rendered on from a point of time ($\tau_0+\tau_4$) in the region where the image region of the photosensitive drum 1 is faced to the developing device 4, and it is kept on for the time period $\delta\tau_1$, corresponding to the image area, and thereafter, it is deactivated.

The registration roller 11 starts to rotate $\tau_5$, and the transfer material 24 20 reaches the transfer nip N in synchronism with the leading edge of the image region along the transfer guide 12. At the point of time $\tau_6$ when the leading edge of the transfer material 24 reaches the transfer nip N, the bias voltage starts to be applied to the transfer roller 23'.

The transfer bias voltage is applied for the time period $\delta\tau_1$ corresponding to the length of the transfer material 24. However, in the time periods $\delta\tau_7$ and $\delta\tau_8$ corresponding to the leading and trailing edge portions, the voltage applied is weakened. In other words, $|V'_{Tr}|<|V_{Tr}|$ where $V_{Tr}$ is the transfer voltage in the image region and the $V'_{Tr}$ is the transfer voltage for the leading and trailing edge portions.

The voltage $V'_{Tr}$ is selected within a range such that the leading and trailing edges of the transfer material 24 are properly separated in accordance with the material and shape (curvature $1/r_T$), it may be 0 V.

The transfer voltages $V'_{Tr}$ may be different between the leading edge and the trailing edge. The leading and trailing edges of the transfer material 24 have blanks corresponding to $\delta\tau_2$ and $\delta\tau_4$, and therefore, even if the transfer bias is weakened, the improper image transfer does not occur, so that good separation performance is accomplished. FIG. 15 illustrates the transfer bias change relative to the length of the transfer material 24 in the conveyance direction.

EMBODIMENT 14

(FIG. 17)

Figure 17:
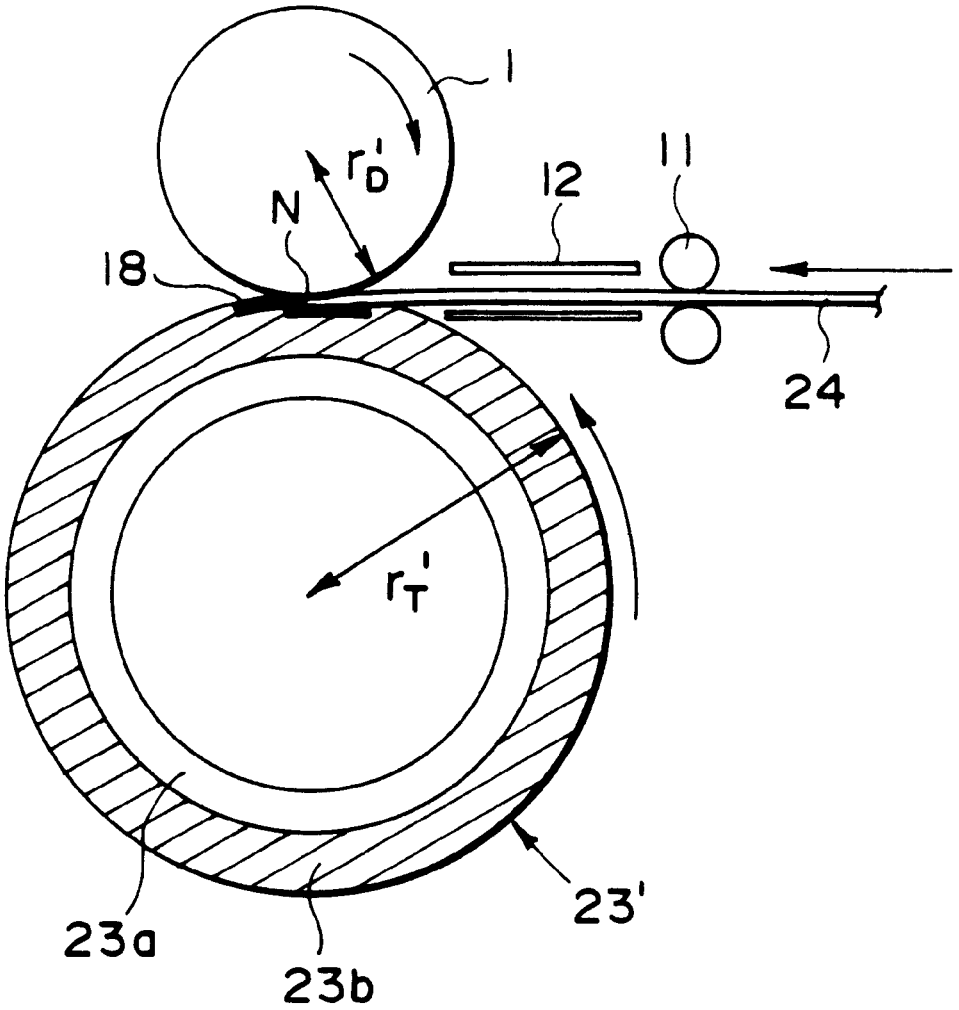
FIG. 17 is a sectional view of an major part of an image forming apparatus according to a 14th embodiment of the present invention.

As shown in FIG. 17, the radius $r'_T$ of the transfer roller 23' is large as compared with the radius $r'_D$ of the photosensitive drum 1, and the curvatures satisfy $1/r'_T<1/r'_D$.

Therefore, the transfer material 24 is attracted more strongly to the transfer roller 23' than to the photosensitive drum 1.

In this embodiment, an insulative region 18 is provided in at least a part of the surface of the transfer roller 23'. The insulative region 18 can be provided by an insulative film of PTFE, PFA, PET or PVdF having a good parting property bonded to the flush with the surface of the elastic layer 23*b* over the entire length of the transfer roller 23' on the conductive elastic layer 23*b* surface. When the length of the transfer material 24 in the conveyance direction is L, the radius $r'_T$ of the transfer roller 23' satisfies $L \leqq 2\pi r'_T$, and when a length on the circumference of the region 18 is m, $2\pi r'_T - m/L$ is satisfied. By doing so, the leading edge of the transfer material 24 is timed with the region 18 by the sequential control.

In the region 18, the transfer charge application to the transfer material 24 is weakened by the function of the insulative material, and therefore, the mirror force becomes small, and the leading end portion of the transfer material 24 is not attracted to the transfer roller 23', and therefore, the leading end portion is smoothly separated from the transfer nip N by the rigidity of the transfer material 24.

When the radius $r'_T$ of the transfer roller 23' satisfies the above requirement, the trailing edge of the transfer material 24 is timed with the region 18, and therefore, the trailing end portion is also properly separated.

As described in the foregoing, by making the curvature $1/r'_T$ of the transfer roller 23' having the conductive elastic layer is smaller than the curvature $1/r'_D$ of the photosensitive drum ($1/r'_T<1/r'_D$), by which the transfer material 24 can be easily separated from the transfer nip N.

In the Embodiments 12–14, the description has been made in connection with a combination of a photosensitive drum I and a transfer roller 23'. However, what is important is the curvatures at the transfer nip N, and therefore, the photosensitive member functioning as the first image bearing member is not necessarily in the form of a drum. For example, the present invention is applicable to the belt photosensitive member with the use of a rigid backup roller to provide a predetermined curvature.

Because the intermediate transfer material has the intermediate resistance, the transfer bias voltage to the intermediate transfer material can be properly selected so as to avoid the strong voltage at and adjacent to the transfer nip with the first image bearing member, and to avoid the electric current leakage even if the intermediate transfer member has fine defects such as pin holes or the like. Then, image disturbance, such as scattering or the like can be prevented, and therefore, the intermediate transfer can be carried out.

Figure 22:
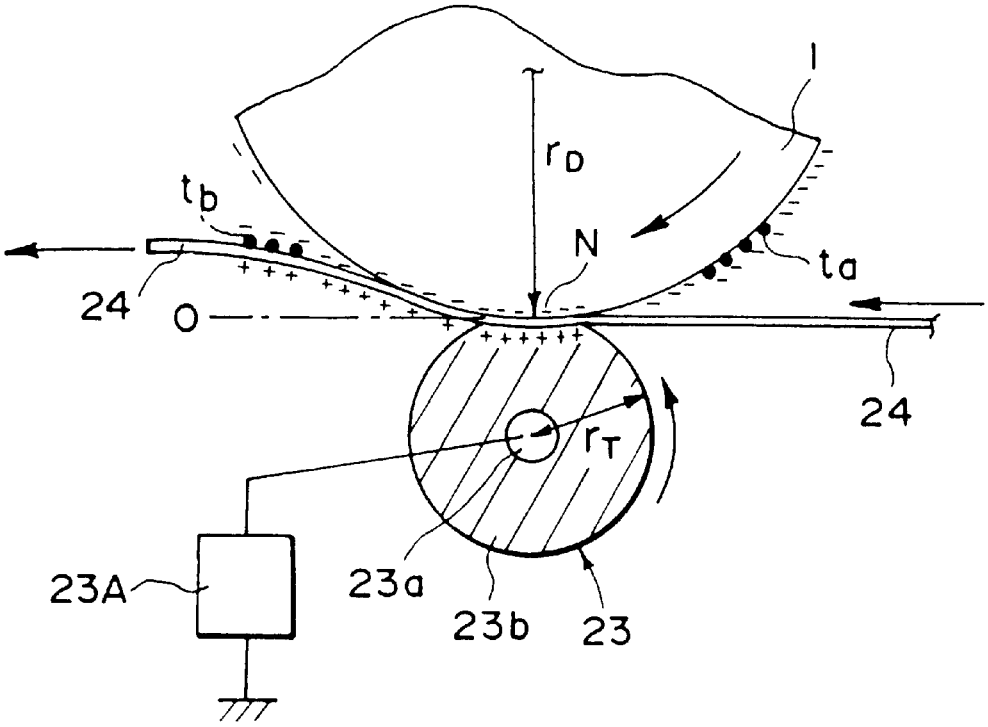
FIG. 22 is an enlarged view of a transfer roller.
Figure 23:
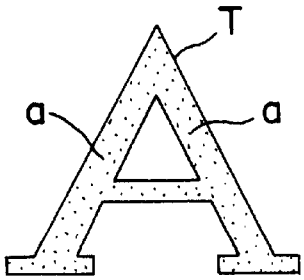
FIG. 23 illustrates a central dropout.

As shown in FIG. 22, when the curvature $1/r_T$ of the transfer roller 23 at the transfer nip N is larger than the curvature $1/r_D$ of the photosensitive drum, the transfer material moves along a line inclined toward the photosensitive drum away from a tangent line of the transfer nip N. Therefore, the transfer material does not come contact with the cleaning device, and therefore, the contamination or image disturbance or jamming can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

a rotatable first image bearing member for bearing a toner image;

a rotatable intermediate transfer member, wherein a toner image on said first image bearing member is transferred onto said intermediate transfer member at a transfer position, and a toner image on said intermediate transfer member is transferred onto a second image bearing member; and electric field forming means for forming an electric field for transferring residual toner remaining on said intermediate transfer member after the toner image is transferred from said intermediate transfer member onto the second image bearing member, back to said first image bearing member from said intermediate transfer member at said transfer position;

wherein a rotational speed of said first image bearing member at said transfer position is different from that of said intermediate transfer member during the back-transfer operation.

2. An apparatus according to claim 1, wherein the rotational speed of said first image bearing member is lower than that of said intermediate transfer member.

3. An apparatus according to claim 1, wherein said intermediate transfer member is provided with an electroconductive layer to which a voltage having the same polarity as the toner image by said electric field forming means during the back-transfer operation by said electric field forming means, and provided with a surface layer thereon.

4. An apparatus according to claim 3, wherein a voltage having a polarity opposite from that of the toner image is applied to said electroconductive layer when the toner image is transferred from said first image bearing member onto said intermediate transfer member.

5. An apparatus according to claim 3, wherein said surface layer has a volume resistivity of $10^5$ to $10^{11}$ Ohm.cm.

6. An apparatus according to claim 1, further comprising cleaning means for removing toner from said first image bearing member.

7. An apparatus according to claim 1, wherein said intermediate transfer member is in the form of a roller.

8. An apparatus according to claim 1, wherein said first image bearing member is capable of carrying a toner image of different colors, which are superimposedly transferred therefrom onto said intermediate transfer member, and the toner images are transferred onto said second image bearing member from said intermediate transfer member.

* * * * *

UNITED STATES PATENT AND TRADEMARK OFFICE

CERTIFICATE OF CORRECTION

PATENT NO. : 5,940,668
DATED : August 17, 1999
INVENTOR(S) : Koichi Tanigawa, et al.

It is certified that error appears in the above-identified patent and that said Letters Patent is hereby corrected as shown below:

Column 2,
Line 26, "charging" should read -- Charging --;
Line 35, "charging" should read -- Charging --;
Line 43, "charging" should read -- Charging --.

Column 3,
Line 38, "applied" should read -- is applied --;
Line 53, "more" should read -- more easily --.

Column 5,
Line 8, "an major" should read -- a major --.

Column 8,
Line 1, "polarity" (2nd occurrence) should read -- opposite --.

Column 9,
Line 3, "$t_a$" should read -- $t_a$) --.

Column 10,
Line 61, "having" should read -- has --.

Column 11,
Line 13, "comprising" should read -- comprises --.

Column 12,
Line 63, "1.5%, the" should read -- 1.5% and the --.

UNITED STATES PATENT AND TRADEMARK OFFICE

CERTIFICATE OF CORRECTION

PATENT NO. : 5,940,668
DATED : August 17, 1999
INVENTOR(S) : Koichi Tanigawa, et al.

It is certified that error appears in the above-identified patent and that said Letters Patent is hereby corrected as shown below:

Column 13,
Line 46, "operation" should read -- operation, --.

Column 14,
Line 62, "desirable the" should read -- desirable that the --.

Figure 16,
Line "ROLLE" should read -- ROLLER --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*